US007037147B2

(12) United States Patent
Kinoshita et al.

(10) Patent No.: US 7,037,147 B2
(45) Date of Patent: May 2, 2006

(54) ENGINE CONTROL SYSTEM FOR WATERCRAFT

(75) Inventors: Yoshimasa Kinoshita, Hamamatsu (JP); Kazumasa Ito, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/624,094

(22) Filed: Jul. 21, 2003

(65) Prior Publication Data

US 2004/0067700 A1 Apr. 8, 2004

(30) Foreign Application Priority Data

Jul. 19, 2002 (JP) ..... 2002-211503
Jun. 10, 2003 (JP) ..... 2003-164792

(51) Int. Cl.
*G63H 21/21* (2006.01)

(52) U.S. Cl. ..... 440/1; 440/87

(58) Field of Classification Search ..... 440/1, 440/84, 87

See application file for complete search history.

(56) References Cited

U.S. PATENT DOCUMENTS 3,183,879 A * 5/1965 Heidner ..... 440/87
4,767,363 A * 8/1988 Uchida et al. ..... 440/1
5,203,727 A * 4/1993 Fukui ..... 440/1
6,168,485 B1 * 1/2001 Hall et al. ..... 440/89 R
2001/0051474 A1 12/2001 Matsuda et al.

FOREIGN PATENT DOCUMENTS

JP 06-137248 5/1994

OTHER PUBLICATIONS

Co-pending U.S. Appl. No. 10/080,371, filed Feb. 15, 2002, in the name of Tsuide Yanagihara, entitled "Engine Control for Watercraft".
Co-pending U.S. Appl. No. 09/900,475, filed Jul. 6, 2001, in the name of Makoto Nagafusa, entitled "Engine Control Arrangement for Watercraft."
Co-pending U.S. Appl. No. 10/331,452, filed Dec. 27, 2002, in the name of Suzuki et al., entitled "Engine Control Device for Water Vehicle."

* cited by examiner

*Primary Examiner*—Andrew D. Wright
(74) *Attorney, Agent, or Firm*—Knobbe, Martens, Olsen & Bear, LLP

(57) ABSTRACT

A personal watercraft has a jet pump propulsion device. An engine powers the propulsion device and a control device controls engine speed. A steering mechanism steers a thrust direction of the propulsion device. An engine load sensor or an engine speed sensor senses an engine load or an engine speed, respectively. A steering position sensor senses an angular position of the steering mechanism. The control device decreases engine speed when the engine load or the engine speed is greater than a preset engine load or the engine speed, respectively, and the angular position of the steering mechanism is greater than a preset angular position.

47 Claims, 18 Drawing Sheets

ENGINE CONTROL SYSTEM FOR WATERCRAFT

PRIORITY INFORMATION

This application is based on and claims priority under 35 U.S.C. §119 to Japanese Patent Applications No. 2002-211503, filed on Jul. 19, 2002, and No. 2003-164792, filed on Jun. 10, 2003, the entire contents of which are hereby expressly incorporated by reference herein.

BACKGROUND OF THE INVENTION

1. Field of the Invention

The present invention generally relates to an engine control system for a watercraft, and more particularly relates to an improved engine control system for a watercraft that controls an engine in accordance with a state of a steering mechanism of the watercraft.

2. Description of Related Art

Personal watercraft has become popular in recent years. This type of watercraft is quite sporting in nature and carries one or more riders. A hull of the personal watercraft commonly defines a rider's area above an engine compartment. An internal combustion engine powers a jet pump unit that propels the watercraft by discharging water rearward. The engine lies within the engine compartment in front of a water tunnel, which is formed on an underside of the hull. The jet pump unit generally is placed within the tunnel and incorporates an impeller. The engine drives the impeller to draw water into the water tunnel and to discharge water rearward from the water tunnel to propel the watercraft.

Typically, the personal watercraft has a steering mechanism. A deflector is mounted at a rear end of the jet pump unit for steering the watercraft. A steering mast with a handlebar is linked with the deflector through a linkage. The steering mast extends upwardly in front of the rider's area. The rider remotely steers the watercraft using the handlebar.

When traveling forward at an elevated speed, dynamic pressure builds within the jet pump unit. The engine must drive the impeller against this increased pressure thereby creating a load on the engine.

The engine typically incorporates a throttle valve disposed in an air intake system of the engine. The throttle valve regulates an air amount supplied to the engine. Normally, as the amount of air increases, the engine output also increases. A throttle lever is attached to the handlebar and is linked with the throttle valve usually through a throttle linkage. The rider thus can control the throttle valve remotely by operating the throttle lever on the handlebar.

SUMMARY OF THE INVENTION

One aspect of the present invention involves the recognition that when a rider sharply steers a personal watercraft the dynamic pressure within the jet pump often significantly decreases. The load on the engine consequently falls, potentially causing the engine to over-rev. In some arrangements, the engine can be provided with a revolution limiter that inhibits the engine from over-revving.

To better appreciate the recognized problem with the prior art, reference is made to an exemplary operation of a personal watercraft in which the revolution limiter often works, as seen in the graph shown in FIG. 1. The engine speed varies generally in accordance with a position of the throttle valve and increases with the throttle valve approaching its wide open position. The steering mechanism can be provided with a steering position sensor that produces a signal "1" when the handlebar is turned sharply to an angular position greater than a preset angular position. In the exemplary operation, the throttle valve is opened to the wide open position several times, as indicated by the reference numeral 10 in FIG. 1. The personal watercraft can travel at an elevated speed when the throttle valve is wide open. Under this condition, if the rider sharply steers the handlebar over a certain angular range (i.e., if the steering position sensor produces the signal "1" as indicated by the reference numeral 12 in FIG. 1), the engine speed quickly increases and over-revs because the dynamic pressure falls as the watercraft turns. Thus, the revolution limiter operates quite often, as indicated by the reference numeral 14.

Consequently a further aspect of the present invention involves an improved engine control system for a watercraft that can inhibit an engine from over-revving even when the watercraft is turned sharply at a relatively high rate of speed. The watercraft comprises an internal combustion engine that powers the propulsion device. A control device is configured to control a magnitude of engine power of the engine. A steering mechanism is arranged to steer a thrust direction of the propulsion device. First sensing means are provided for sensing the magnitude of engine power or a magnitude of engine load. Second sensing means are provided for sensing an angular position of the steering mechanism. The control device decreases the magnitude of engine power when the control device determines that the magnitude of engine power is greater than a preset magnitude of engine power or the magnitude of engine load is greater than a preset magnitude of engine load based upon an output from the first sensing means and that the angular position of the steering mechanism is greater than a preset angular position based upon an output from the second sensing means.

In accordance with another aspect of the present invention, a watercraft comprises an internal combustion engine that powers the propulsion device. A control device is configured to control an engine speed of the engine. A steering mechanism is arranged to steer a thrust direction of the propulsion device. An engine load sensing device is configured to sense an engine load of the engine. A steering position sensing device is configured to sense an angular position of the steering mechanism. The control device decreases the engine speed when the control device determines that the engine load is greater than a preset engine load based upon an output from the engine load sensing device and that the angular position of the steering mechanism is greater than a preset angular position based upon an output from the steering position sensing device.

In accordance with a further aspect of the present invention, a watercraft comprises an internal combustion engine that powers the propulsion device. A control device is configured to control an engine speed of the engine. A steering mechanism is arranged to steer a thrust direction of the propulsion device. An engine speed sensing device is configured to sense an engine speed of the engine. A steering position sensing device is configured to sense an angular position of the steering mechanism. The control device decreases the engine speed when the control device determines that the engine speed is greater than a preset engine speed based upon an output from the engine speed sensing device and that the angular position of the steering mechanism is greater than a preset angular position based upon an output from the steering position sensing device.

In accordance with a further aspect of the present invention, a control method is provided. The watercraft has a steering mechanism arranged to steer a direction of the watercraft. The control method comprises sensing a magnitude of engine power of the engine or a magnitude of engine load, sensing an angular position of the steering mechanism, determining whether the magnitude of engine power is greater than a preset magnitude of engine power or the magnitude of engine load is greater than a preset magnitude of engine load, determining whether the angular position of the steering mechanism is greater than a preset angular position, and decreasing the magnitude of engine power when the magnitude of engine power is greater than the preset magnitude of engine power or the magnitude of engine load is greater than the preset magnitude of engine load and the angular position of the steering mechanism is greater than the preset angular position.

In accordance with a further aspect of the present invention, a control method is provided. The watercraft has a steering mechanism arranged to steer a direction of the watercraft. The control method comprises sensing an engine load of the engine, sensing an angular position of the steering mechanism, determining whether the engine load is greater than a preset engine load, determining whether the angular position of the steering mechanism is greater than a preset angular position, and decreasing an engine speed of the engine when the engine load is greater than the preset engine load and the angular position of the steering mechanism is greater than the preset angular position.

In accordance with a further aspect of the present invention, a control method is provided. The watercraft has a steering mechanism arranged to steer a direction of the watercraft. The control method comprises sensing an engine speed of the engine, sensing an angular position of the steering mechanism, determining whether the engine speed is greater than a preset engine speed, determining whether the angular position of the steering mechanism is greater than a preset angular position, and decreasing an engine speed when the engine speed is greater than the preset engine speed and the angular position of the steering mechanism is greater than the preset angular position.

BRIEF DESCRIPTION OF THE DRAWINGS

These and other features, aspects and advantages of the present invention are described below with reference to the drawings of preferred embodiments, which are intended to illustrate and not to limit the invention. The drawings comprise 18 figures.

FIG. 1 includes lower and upper graphs. The lower graph shows engine speed and throttle valve opening degree versus time. The upper graph shows operations of a revolution limiter and a steering position sensor versus the time.

DETAILED DESCRIPTION OF THE PREFERRED EMBODIMENTS OF THE INVENTION

Figure 1:
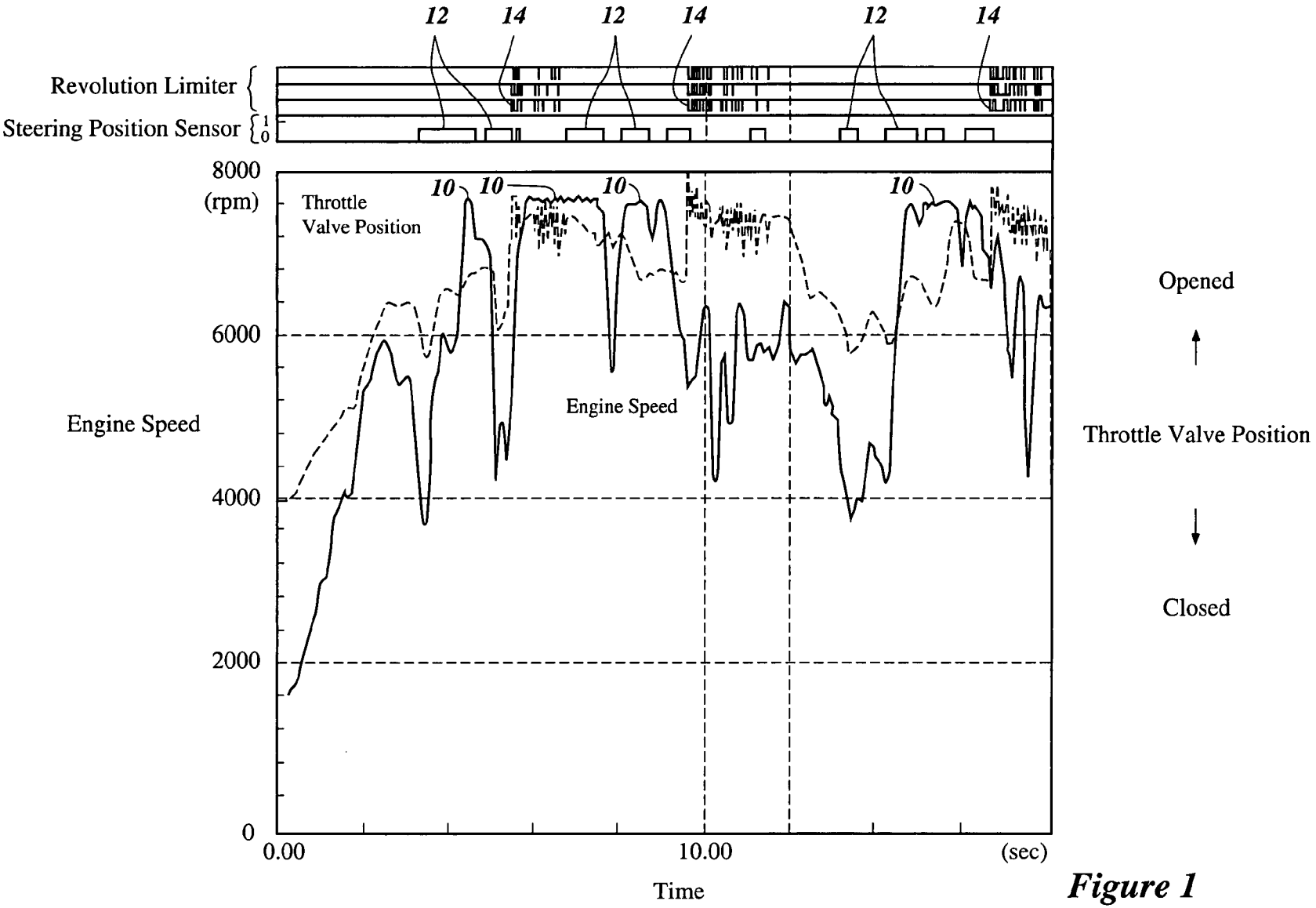
FIG. 1, as mentioned above, illustrates an exemplary operation of a personal watercraft in which a revolution limiter often works. The FIG. 1 is intended to provide a better understanding of a problem that is addressed by one or more of the preferred embodiments of the engine control system.
Figure 2:
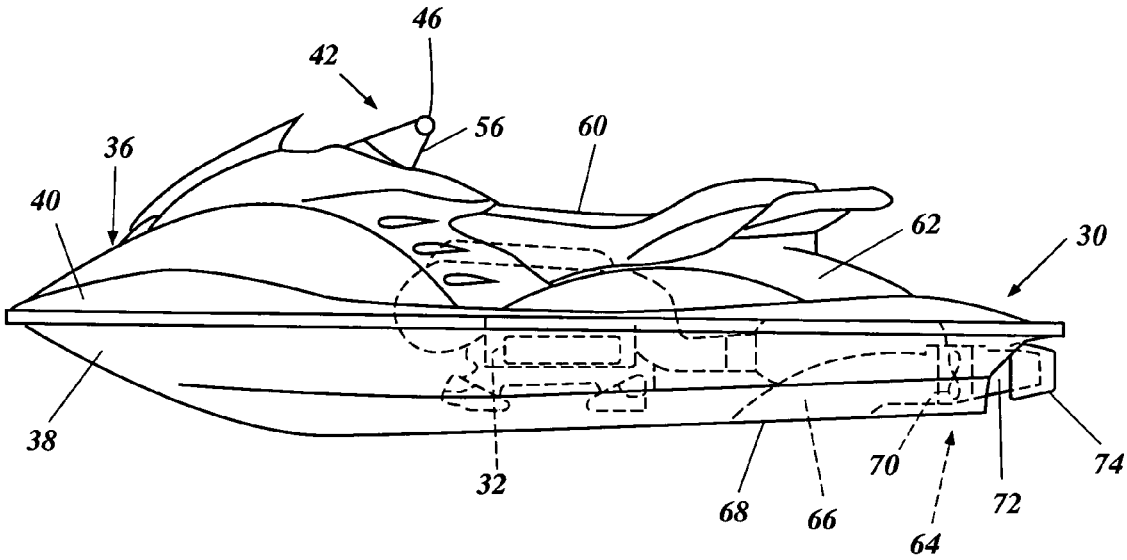
FIG. 2 illustrates a side elevational view of a personal watercraft for which an engine control system configured in accordance with a preferred embodiment of the present invention can be applied.

With initial reference to FIGS. 2–6, an overall construction of a personal watercraft 30 is described. The watercraft 30 incorporates an internal combustion engine 32 controlled by an engine control system 34 (FIG. 7) that is configured and operated in accordance with a preferred embodiment of the present invention. This engine control system 34 has particular utility with a personal watercraft, and thus is described in the context of the personal watercraft. The control system, however, can be applied to other types of watercraft as well, such as, for example, small jet boats.

The personal watercraft 30 preferably comprises a hull 36 generally formed with a lower hull section 38 and an upper hull section or deck 40. The lower hull section 38 can include one or more inner liner sections to strengthen the hull 36 or to provide mounting platforms for various internal components of the watercraft 30. Both the hull sections 38, 40 preferably are made of, for example, a molded fiberglass reinforced resin or a sheet molding compound. The lower hull section 38 and the upper hull section 40 are coupled together to define an internal cavity. A gunwale or bulwark defines an intersection of the hull sections 38, 40.

Figure 3:
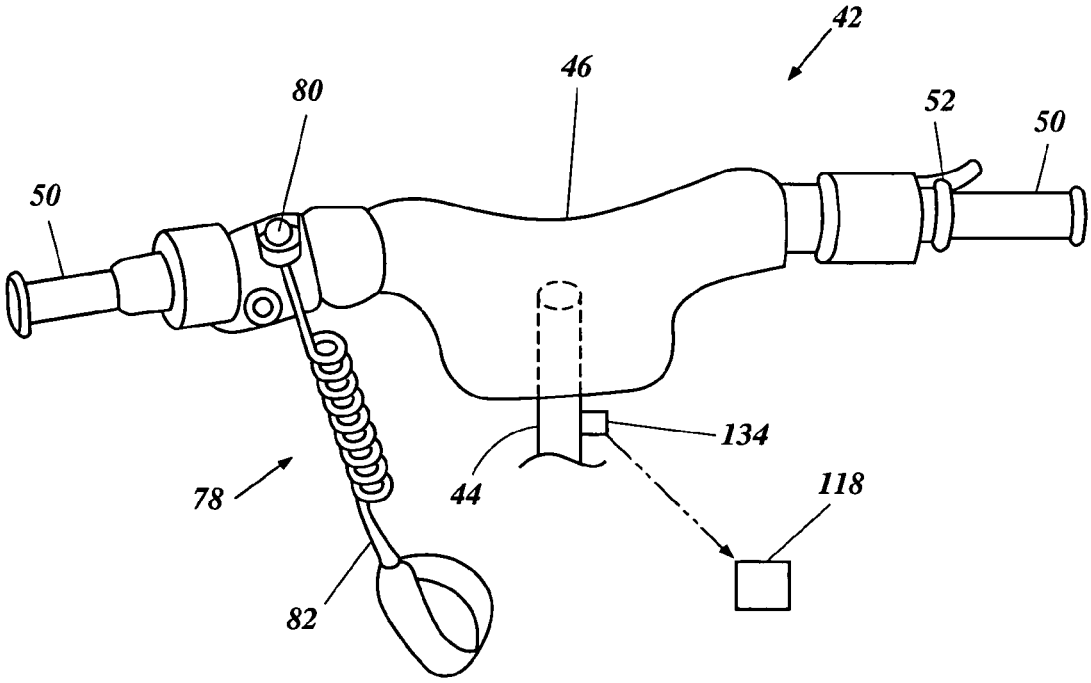
FIG. 3 illustrates a partial perspective view of a steering mechanism of the personal watercraft of FIG. 2, wherein a steering position sensor is schematically illustrated.

A steering mechanism 42 is provided to steer the watercraft 30. The steering mechanism 42 preferably comprises a steering mast 44 (FIG. 3) extending upwardly. A handlebar 46 is disposed atop the steering mast 44 primarily for a rider to operate the steering mast 44 and changes a thrust direction of the watercraft 30. With particular reference to FIG. 3, grips 50 are formed at both ends of the handlebar 46. The rider can hold them for steering the watercraft 30. The handlebar 46 also carries control devices such as, for example, a throttle lever 52 for remotely operating throttle valves 54 (FIGS. 4–6) of the engine 32. In the illustrated arrangement, the steering mast 46 is covered with a padded steering cover member 56.

A seat 60 preferably extends longitudinally fore to aft along a center plane of the hull 36 at a location behind the steering mast 44. In this description, the term "center plane" means that a plane extending fore to aft and generally vertically relative to the hull 36. The area, in which the seat 60 is positioned, is a rider's area. The seat 60 has generally a saddle shape so that the rider can straddle the seat 60. Foot areas are defined on both sides of the seat 60 and at the top surface of the upper hull section 40. The seat 60 has a rigid backing supported by a pedestal 62 which is part of the upper hull section 40. The seat 60 is detachably disposed on the pedestal 62. An access opening is defined on the top surface of the pedestal 62 and beneath the seat 60. The rider can access an engine compartment defined between the lower and upper hull sections 38, 40. The engine 32 is placed in the engine compartment.

A fuel tank preferably is placed in a cavity that is formed by the hull sections 38, 40 in front of the engine and opens into the engine compartment. The fuel tank is coupled with a fuel inlet port positioned at a top surface of the upper hull section 40 through a filler duct. A closure cap closes the fuel inlet port.

Preferably, a pair of air ducts or ventilation ducts is provided on both sides of the upper hull section 40 such that the ambient air can enter the engine compartment through the ducts. Except for the air ducts, the engine compartment is substantially sealed so as to protect at least the engine 32 from water.

A jet pump unit 64 preferably propels the watercraft 30. The jet pump unit 64 is disposed in a water tunnel 66 formed on the underside of the lower hull section 38. In some hull designs, the water tunnel 66 is isolated from the engine compartment by a bulkhead. The tunnel 66 has a downward facing inlet port 68 opening toward a body of water. The jet pump unit 64 includes an impeller 70 rotatably disposed within a housing that communicates with the water tunnel 66. An impeller shaft extends forwardly from the impeller 70 and is coupled with a crankshaft of the engine 32 so as to be driven by the crankshaft. The jet pump unit 64 has a discharge nozzle 72 at the rear-most end thereof. Water is drawn into the water tunnel 66 with the impeller rotating and is spouted rearward through the discharge nozzle 72.

A deflector or steering nozzle 74 preferably is affixed to the discharge nozzle 72 for pivotal movement about an axis of a deflector supporting shaft extending generally vertically on the discharge nozzle 72. A cable connects the deflector 74 with the steering mast 44. Thus, the deflector 74 and the cable are part of the steering mechanism 42. The rider can steer the deflector 74 through the steering mast 44 and the cable by operating the handlebar 56. The deflector 74 can turn right or left about the steering axis. That is, the deflector 74 can change its angular position relative to the center plane. The water thus can exit the jet pump unit 64 in any direction within a movable range of the deflector 74 in response to the rider's operation of the handlebar 56. The watercraft 30 changes its advance direction accordingly.

When the crankshaft of the engine 32 drives the impeller shaft and hence the impeller 70 rotates, water is drawn from the body of water through the inlet port 68. The pressure generated in the jet pump unit 64 by the impeller 70 produces a water jet that is discharged through the discharge nozzle 72 and the deflector 74. The water jet produces thrust force to propel the watercraft 30. Maneuver of the deflector 74 changes the direction of the water jet. The rider thus can turn the watercraft 30 in either a right or left direction, as noted above.

A reverse bucket (not shown) preferably is disposed relative to the deflector 74 for pivotal movement about a generally horizontally extending axis. The operator can operate the bucket through another cable to direct the water generally forwardly. The watercraft 30 moves backward when the bucket is operated and the water is directed forwardly.

With reference to FIG. 3, the personal watercraft 30 preferably has a lanyard switch unit 78 on the handlebar 46. The lanyard switch unit 78 comprises a switch section 80 and a lanyard or tether section 82. One end of the lanyard section 82 normally is affixed to the switch section 80 to keep the switch section 80 active, thereby allowing the engine 32 to operate. Another end of the lanyard section 82 can be put around the rider's wrist or the like. In the event the rider falls into the water, the lanyard section 82 comes off the switch section 80 to stop the engine operation.

Figure 4:
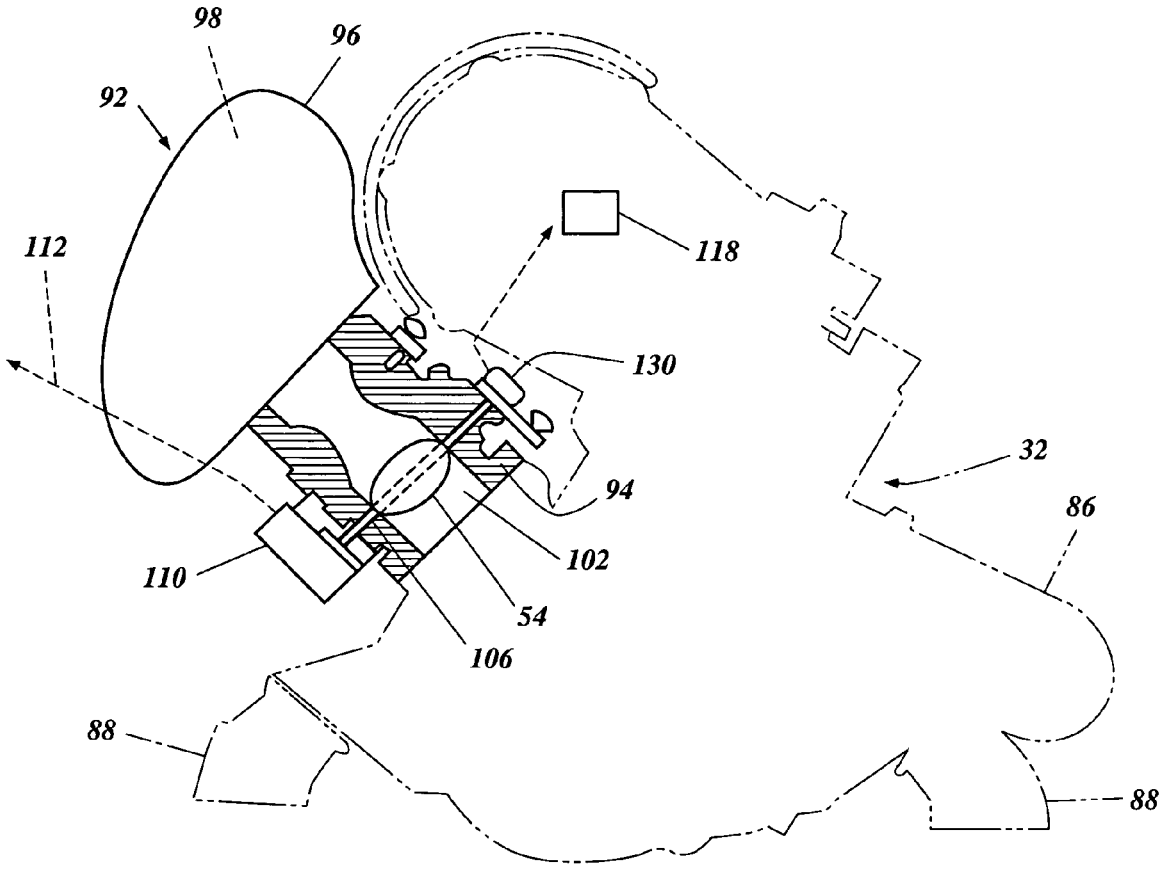
FIG. 4 schematically illustrates a front view of an engine of the personal watercraft of FIG. 2, wherein a large part of the engine, except for an air intake system, is illustrated in phantom, and a throttle valve position sensor (throttle valve opening degree sensor) is schematically illustrated.
Figure 5:
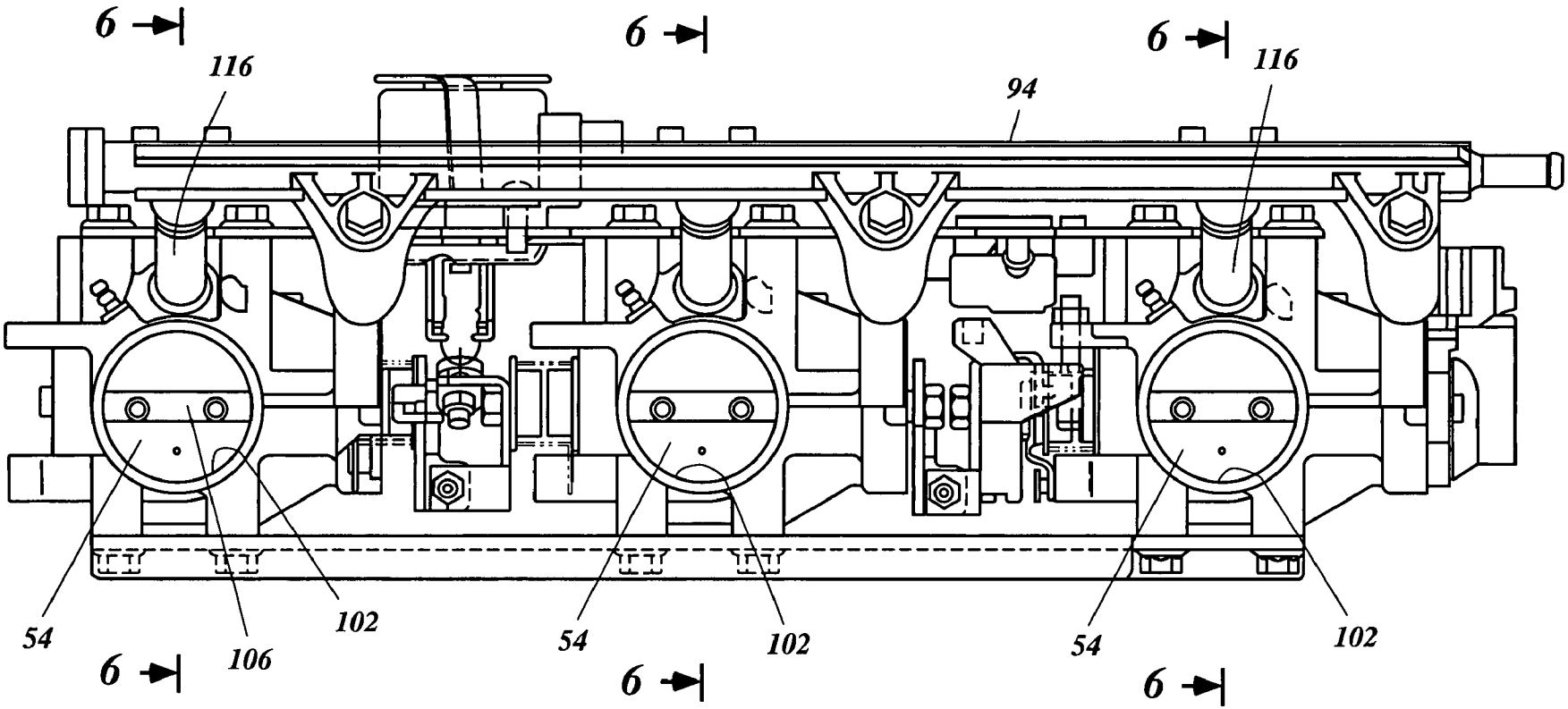
FIG. 5 illustrates a view of part of the air intake system and a fuel injection system of the engine of FIG. 4 looking down into induction passes of the air intake system.
Figure 6:
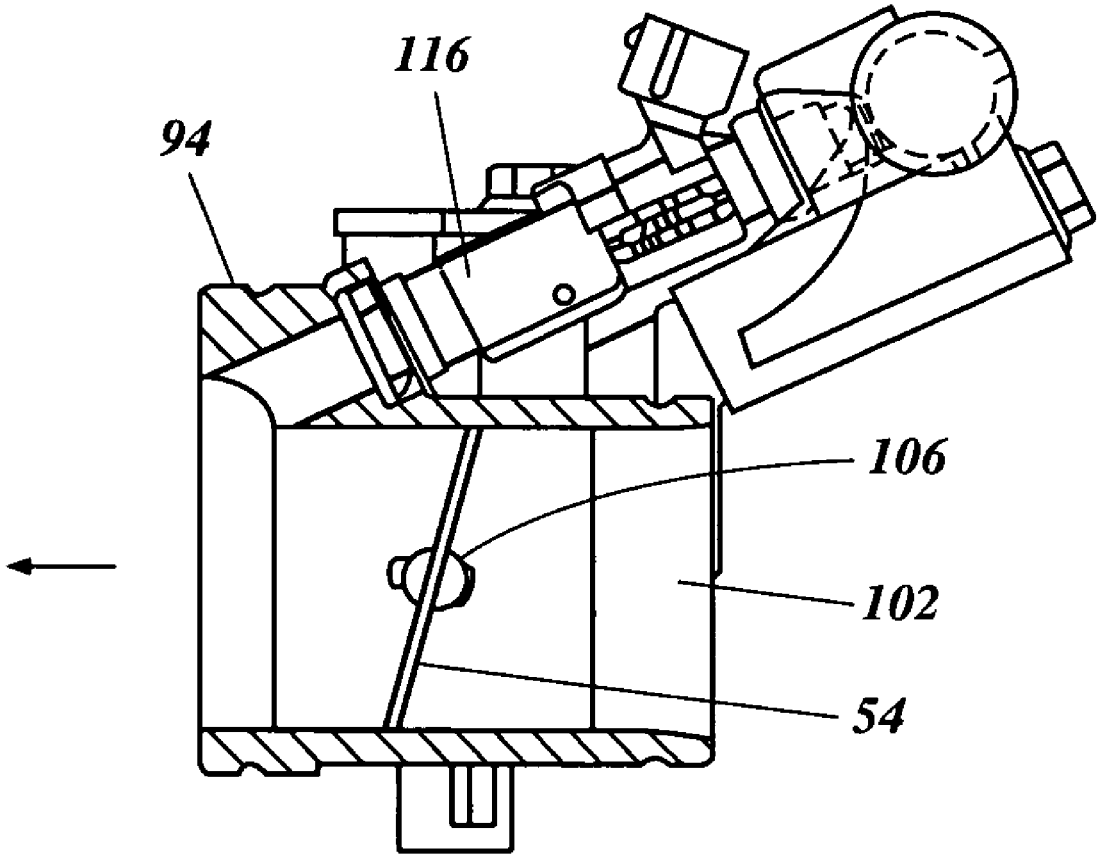
FIG. 6 illustrates a cross-sectional view of the intake system and the fuel injection system taken along the lines 6—6 of FIG. 5.

With reference to FIGS. 4–6, the engine 32 preferably operates on a two-cycle crankcase compression principle and in the illustrated embodiment has three cylinders spaced apart from one another along the longitudinal center plane of the watercraft 30. The illustrated engine, however, merely exemplifies one type of engine. The engine control system 34 can be applied to any engines operating on other combustion principles (e.g., four-cycle or rotary), having other number of cylinders, having any cylinder arrangements, and having any cylinder orientations (e.g., upright cylinder banks).

The engine 32 preferably comprises a cylinder block defining three cylinder bores in which pistons reciprocate. A cylinder head member preferably is affixed to an upper end of the cylinder block to close respective ends of the cylinder bores on the upper side and defines three combustion chambers with the cylinder bores and the pistons. A crankcase member is also affixed to a lower end of the cylinder block to close other ends of the cylinder bores and to define a crankcase chamber with the cylinder block. The crankcase chamber preferably is divided into three sub-chambers. The crankshaft is rotatably connected to the pistons through connecting rods and is journaled for rotation within the crankcase chamber. The cylinder block, the cylinder head and the crankcase member preferably are made of aluminum alloy and together define an engine body 86.

Engine mounts 88 extend from lower sides of the engine body 86. The engine mounts 88 preferably are made of a resilient material such as, for example, a rubber. The engine body 86 is mounted on the lower hull section 38 (or possibly on the hull liner) by the engine mounts 88 such that vibration of the engine 32 is inhibited from propagating to the lower hull section 38.

The engine 32 preferably comprises an air intake system 92 to introduce air to the combustion chambers. In the illustrated arrangement, the air intake system 92 generally is disposed on the starboard side of the engine body 86. The intake system 92 includes three throttle bodies 94 affixed to the crankcase member, and a single plenum chamber member or air intake box 96.

The plenum chamber member 96 defines a plenum chamber 98 therein and has an air inlet through which the air in the engine compartment is drawn into the plenum chamber 98. The plenum chamber 98 smoothes the intake air and attenuates intake noise.

The respective throttle bodies 94 are spaced apart from each other along the center plane of the watercraft 30 so as to each be allotted to one of the respective cylinders. Each throttle body 94 is interposed between the plenum chamber member 96 and each subchamber of the crankcase, and each throttle body 94 defines an intake passage 102. The air in the plenum chamber 98 is drawn into the sub-chambers through the intake passages 102. The sub-chamber is connected to an inlet port opening to the cylinder bore through at least one scavenge passage. The inlet port is selectively opened and closed by the associated piton moving reciprocally. The scavenge passages thus communicate with the respective combustion chambers when the inlet ports are opened.

Each intake passage 102 has the throttle valve 54. In the illustrated embodiment, each throttle valve 54 is a butterfly type valve and has a throttle valve shaft 106 journaled for pivotal movement. The throttle valve 54 thus can pivot to change its position or opening degree relative to the associated intake passage 102. The throttle valve 54 regulates an amount of air that flows through the intake passage 102, as will be described shortly.

The throttle valve shaft 106 can be provided at each intake passage 102 separately from one another as schematically shown in FIG. 4 and then be connected with each other by a linkage mechanism so as to pivot together. Alternatively, one or multiple throttle valve shafts 106 can extend transversely through the entire intake passages 102 as shown in FIGS. 5 and 6. That is, an axis of the transverse throttle valve shaft(s) 106 (FIGS. 5 and 6) extends normal to an axis of the throttle valve shaft 106 shown in FIG. 4.

One of the throttle valve shafts 106 has a pulley 110 at one end thereof. The foregoing throttle lever 52 is connected to the pulley 110 through a throttle cable 112. The throttle cable 112 preferably is a mechanical cable. The throttle valves 54 thus can move between a fully closed position and a fully open position when the rider operates the throttle lever 52. An amount of airflow in the respective intake passages 102 thus is regulated in accordance with the position (or opening degree) of the throttle valves 54. A bias spring such as, for example, a coil spring, preferably urges the throttle valve 54 toward the fully closed position. The throttle valve 54 is moved toward the fully open position when the throttle lever 52 is operated by the rider.

Normally, the greater the throttle valves 54 open, the higher the rate of air flow amount. Also, an intake pressure downstream of the respective throttle valves 54 changes generally in response to the throttle valve position and the air flow amount. The intake pressure is a negative pressure. An engine speed can become higher when the throttle valves 54 open greater if an engine load of the engine 32 is fixed.

The engine speed is a typical index of a magnitude of engine power. A velocity of the personal watercraft 30 varies generally along with the engine speed. For instance, the watercraft 30 can advance in a higher velocity when the engine speed is higher because the magnitude of engine power is large. Other indexes can represent the magnitude of engine power. For example, an engine torque can be one of the indexes.

In the illustrated embodiment, the magnitude of engine power varies in accordance with the opening degree of the throttle valves 54. The opening degree of the throttle valves 54 thus is an index of a magnitude of engine load (i.e., cause for engine power) in this embodiment. Other indexes can represent the magnitude of engine load. For example, an intake pressure or an air flow amount can be an index for the amount of load on the engine.

The engine 32 preferably comprises a fuel supply system that incorporates the foregoing fuel tank, a charge forming device and a fuel delivery mechanism connecting the fuel tank with the charge forming device. The charge forming device can take various structures such as, for example, a carburetor or a direct or indirect fuel injection system. In this arrangement, the engine 32 employs an indirect fuel injection system that spray fuel into the intake passages 102 for combustion in the combustion chambers.

The fuel injection system comprises three fuel injectors 116 (FIGS. 5 and 6) directed toward the respective intake passages 102. The fuel injection system also comprises multiple fuel pumps coupled in series to pressurize the fuel delivered to the fuel injectors 116. Each fuel injector 116 has an injection nozzle that is exposed to each intake passage 102. Preferably, a pressure regulator strictly regulates a fuel pressure at the injection nozzle.

The injection nozzle preferably is selectively opened and closed by a plunger slidably disposed within an injector body. An electromagnetic solenoid is disposed also in the injector body to actuate the plunger between an opening position and a closing position. An electronic control unit (ECU) 118 (FIGS. 3, 4 and 7) preferably controls an injection timing and a duration of the fuel injection. Because the pressure regulator regulates the fuel pressure, an amount of the injected fuel is determined only based upon the duration.

The ECU 118 normally controls the duration of the fuel injection (i.e., the fuel injection amount) to form an air/fuel charge that has the most suitable air/fuel ratio for a given operating condition (the ratio usually is generally at or near stoichiotetric (14.7:1), i.e., is "balanced"). If the charge has a balanced air/fuel ratio, the engine 32 can maximize output or torque when the air/fuel charge is burnt in the combustion chambers. The air/fuel ratio, however, is determined in consideration of emission from the engine 32 in addition to the engine power. In order to keep the most suitable air/fuel ratio, the ECU 118 changes the fuel injection amount in accordance with the air amount flowing through the intake passages 102. If the air/fuel mixture becomes excessively lean or rich, the air/fuel ratio becomes unbalanced and the engine's output suffers. Normally, engine speed of a marine engine (such as the engine 32) varies generally in proportion to the engine's output. Thus, engine speed falls along with the engine's output.

The engine 32 preferably comprises an ignition system. In the illustrated embodiment, three spark plugs are affixed to the cylinder head member. A spark gap of each spark plug is exposed to a respective combustion chamber. The ignition system has an ignition circuit to activate the spark plugs. The spark plugs ignite air/fuel charges in the combustion chambers at proper ignition timings under control of the ECU 118 via the ignition circuit. The air/fuel charges burn and expand one after another to move the pistons. The crankshaft thus rotates and drives the impeller.

The ECU 118 can change the ignition timings of the spark plugs. If the ECU 118 delays or advances the ignition timing of each spark plug relative to a proper timing, the engine's output decreases and accordingly engine speed also decreases. An excessive degree of advance of the ignition timing can cause a knocking phenomenon in the combustion chambers.

The ignition system preferably includes a revolution limiter that operates under control of the ECU 118 to stop or skip the ignitions at the spark plugs when the engine 32 over-revs, i.e., the engine speed exceeds a preset high speed level. In the illustrated embodiment, the preset high engine speed that is associated with the engine over-revving is, for example, 7,500 rpm.

The engine 32 preferably comprises an exhaust system to route burnt charges, i.e., exhaust gases, from the combustion chambers to a location outside of the watercraft 30. Exhaust ports are defined at portions of the cylinder bores in the cylinder block and can communicate with the associated combustion chambers. The exhaust ports are selectively opened and closed by the pistons reciprocating within the cylinder bores. An exhaust manifold is connected to the cylinder block and communicates with the exhaust ports. Multiple exhaust conduits are coupled with the exhaust manifold on a side opposite to the exhaust ports and in series to extend around the engine body 86 and then toward the water tunnel 66. A discharge conduit, which is the last one of the exhaust conduits, is connected to a portion of the tunnel 66. The exhaust gases are discharged into the tunnel 66 through the discharge conduit.

Figure 7:
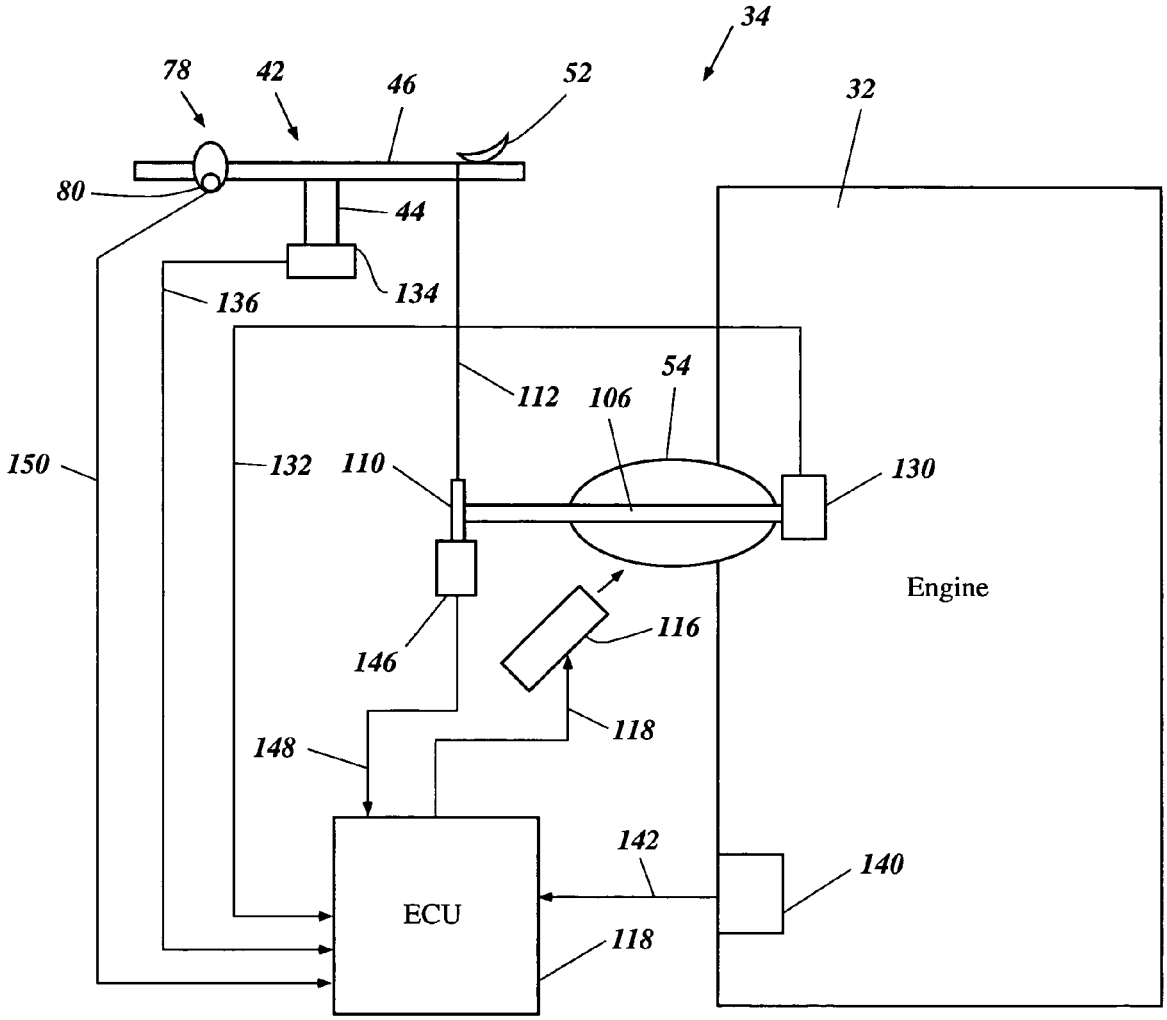
FIG. 7 is a diagram of the engine control system of the personal watercraft of FIG. 2.

With reference to FIGS. 3, 4 and 7–9, the engine control system 34 is described in greater detail below. With particular reference to FIG. 7, the engine control system 34 includes the ECU 118. The ECU 118 preferably is disposed at a location in the engine compartment close to the engine 32. The ECU 118 can be mounted on the engine body 86 in some applications. The ECU 118 comprises at least a central processing unit (CPU) and one or more memories. The memories store control programs and control maps. The CPU controls engine operations using the control programs and the control maps. Preferably, the CPU uses a basic control program unless something happens that needs a particular control routine. If a particular control routine is necessary, the CPU uses a sub-program that is adapted to the particular control.

In order to control the engine 32, the illustrated ECU 118 preferably knows the operating conditions of the engine 32 and a condition of the steering mechanism 42. Sensors are provided for this purpose.

A throttle valve position sensor or throttle valve opening degree sensor 130 is disposed at an end of the throttle valve shaft 106 opposite to the pulley 110 to sense an angular position of the throttle valves 54. In the illustrated embodiment, the throttle valve position sensor 130 includes a potentiometer. A signal indicative of the throttle valve position is sent to the ECU 118 through a sensor signal line 132. The signal represents the rider's demand for the engine's output and thus also represents engine load.

A steering position sensor 134 is disposed at the steering mast 44 to sense an angular position of the steering mast 44. In the illustrated control system 34, the steering position sensor 134 produces a high voltage signal "1" when the steering mast 44 is steered to or over a preset angular position such as, for example, 19 degrees. Otherwise, the steering position sensor 134 produces no voltage or a low voltage signal "0". A potentiometer, of course, can also be used as the steering position sensor 134. In some arrangements, the steering position sensor 134 can be placed to interact with other components of the steering mechanism 42 such as, for example, with the cable connecting the steering mast 44 and the deflector 74 or with the deflector supporting shaft. A signal indicative of the steering position is sent to the ECU 118 through a sensor signal line 136.

Also, there is provided a crankshaft angle position sensor 140 that outputs a crankshaft angle position signal to the ECU 118 through a sensor signal line 142. The ECU 118 can calculate an engine speed using the crankshaft angle position signal versus time. In this regard, the crankshaft angle position sensor 140 and part of the ECU 118 form an engine speed sensor.

Additionally, an auxiliary throttle valve position sensor 146 is disposed at the pulley 110 to sense when the throttle valves 54 are fully closed. A signal indicative of this condition is sent to the ECU 118 through a sensor signal line 148. The auxiliary throttle valve position sensor 146 can be omitted in some arrangements if the throttle valve position sensor 130 senses when the throttle valves 54 are fully closed.

A state of the switch section 80 of the lanyard switch unit 78 is sent to the ECU 118 through a signal line 150. The ECU 118 preferably commands the fuel injectors 116 to stop injecting the fuel when the lanyard section 82 is pulled from the switch section 80.

With reference to FIGS. 2–4, 7 and 8, the personal watercraft 30 can have a higher speed when the engine speed of the engine 32 is increased, as described above. A proper dynamic pressure affects the impeller 70. Under this condition, if the rider sharply steers the handlebar 46 over a certain angular range (e.g., 19 (e.g., 19°), the engine speed increases quickly because of a falloff of the dynamic pressure within the jet pump unit 68, against which the engine works, and consequently the engine can over-rev.

The illustrated ECU 118 can inhibit the engine 32 from over-revving in the event that the watercraft 32 is sharply steered while traveling at higher velocities. In the illustrated control system 34, the CPU of the ECU 118 controls an amount of fuel injected by the fuel injectors 116 to inhibit the over-revving. Preferably, the ECU 118 controls a duration of each fuel injection to control the fuel injection amount. In this control, the ECU 118 preferably uses a particular control program 126, illustrated in FIG. 8, and a control map that has a fuel adjustment amount versus engine speed. A control signal is sent to the solenoid of the respective fuel injectors 116 from the ECU 118 through a control signal line 118. Preferably, the ECU 118 samples the throttle valve position, the steering position and the engine speed Es. The ECU 118 preferably increases an amount of the fuel using the control map for a preset period of time. More specifically, the ECU 118 commands the solenoid of the fuel injectors 116 to elongate the duration in referring to the engine speed. The air/fuel ratio becomes unbalanced and the engine speed thus slows.

Figure 8:
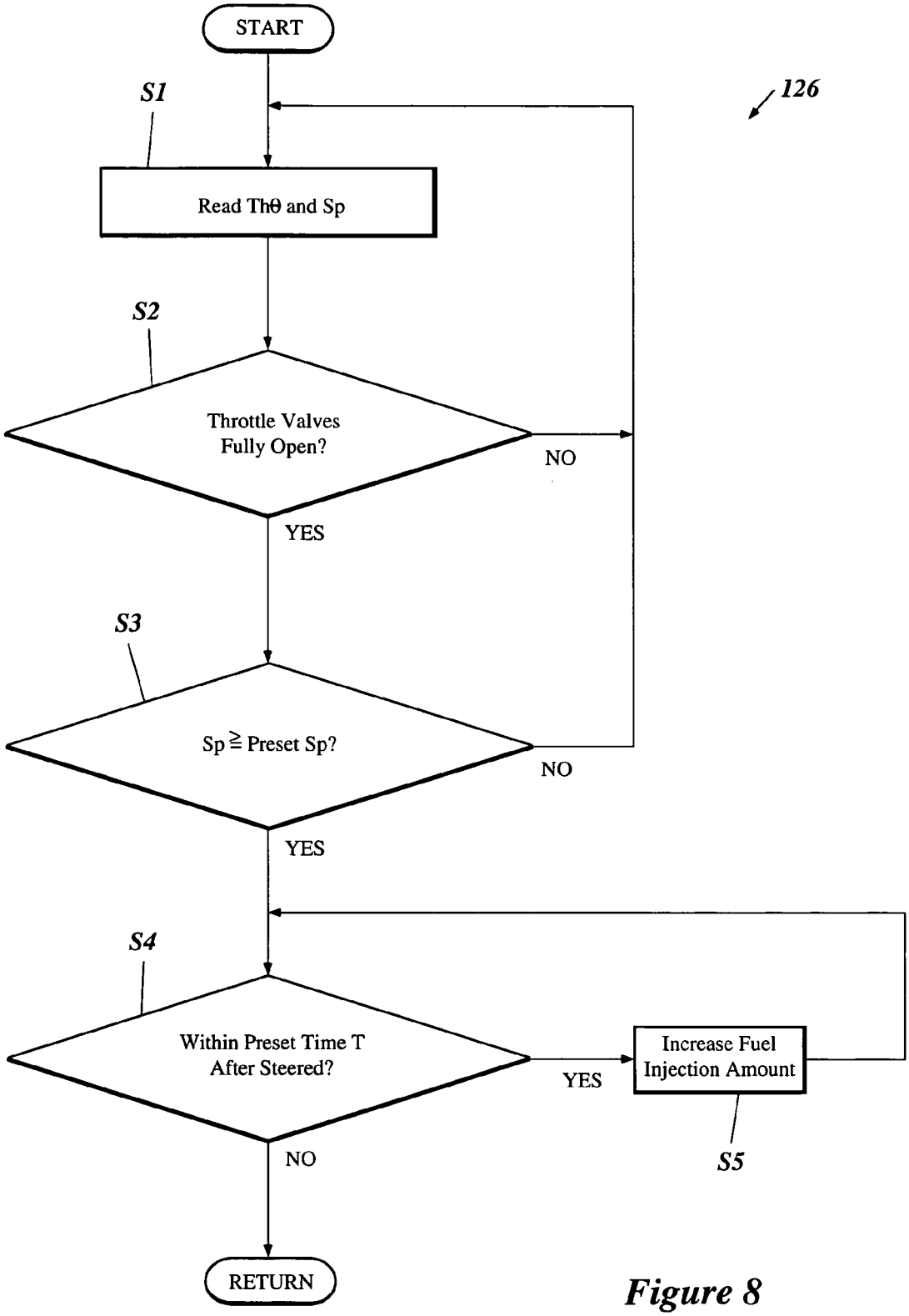
FIG. 8 illustrates a flow chart of a preferred embodiment of a control program applied for the engine control system of FIG. 7 under a particular operating condition.

With reference to FIG. 8, a control operation by the control system 34 will now be described in greater detail below. In this control operation, the ECU 118 uses the control program 126 as the sub-program.

The program 126 begins at step S1. The ECU 118 reads a throttle valve position Thθ and a steering position Sp from the throttle valve position sensor 130 and the steering position sensor 134, respectively. The ECU 118 also reads the engine speed Es which the ECU calculates based upon the signal from the crankshaft angle position sensor 140. The program 126 then proceeds to Step S2.

The ECU 118, at Step S2, determines whether the throttle valves 54 generally are fully opened using the throttle valve position Thθ. If the determination is negative, the ECU 118 recognizes that no particular control is necessary and the program 126 returns back to Step S1 to repeat Step S1. The ECU 118 controls the engine 32 with the basic control program under this condition. If, on the other hand, the determination at Step S2 is positive, the program 126 goes to Step S3.

At Step S3, the ECU 118 determines whether the steering mast 44 is steered to or beyond a preset angular position using the steering position Sp. As noted above, the preset angular position is 19 degrees in the illustrated control program 126. If the determination is negative, the ECU 118 also recognizes that no particular control is necessary. The program 126 returns back to Step S1 to repeat Step S1. The ECU 118 controls the engine 32 with the basic control program under this condition. If the determination at Step S3 is positive, the program 126 goes to Step S4.

At Step S4, the ECU 118 determines whether a time that elapses after the steering mast 44 was steered beyond 19° is within a preset time T. The preset time T preferably corresponds to a period of time in which the dynamic pressure fades out. In the illustrated control, the preset time T is one second, for example. The determination is positive at the first moment and the program goes to Step S5.

The ECU 118, at Step S5, increases the fuel injection amount in reference to the control map that provides a fuel injection amount versus an engine speed Es. That is, the ECU 118 elongates the duration of the fuel injection by the fuel injectors 116 in accordance with the engine speed Es that is read at Step S1. For example, if the engine speed Es is 7,200 rpm, a tenth (10%) of a normal fuel injection amount at this engine speed 7,200 rpm is added to the normal fuel injection amount as an extra amount. Also, if the engine speed Es is 7,500 rpm, one half (50%) of a normal fuel injection amount at this engine speed 7,500 rpm is added to the normal fuel injection amount. In this regard, the normal fuel injection amount corresponds to an air amount regulated by the throttle valves 54 to achieve a proper air/fuel ratio for normal engine operations. Because the fuel injection amount is increased, the air/fuel ratio becomes rich. The engine speed thus will rapidly decrease to a speed range below the over-revving state.

The program 126 then returns back to Step S4 to determine whether the time is still within the preset time T. If the determination is positive, the program 126 proceeds to and repeats Step S5. That is, the program 126 loops between Steps S4 and S5 and the ECU 118 repeats Step S5 until the preset time elapses. The ECU 118 preferably increases the fuel injection amount with the same percentage as previously increased. Alternatively, the ECU 118 can decrease the increment amount with a lower percentage than the percentage previously increased because the engine speed has already fallen from the engine speed sensed at Step S1. When the determination at Step S4 becomes negative, the program 126 returns back to Step S1. The engine speed has slowed down.

Figure 9:
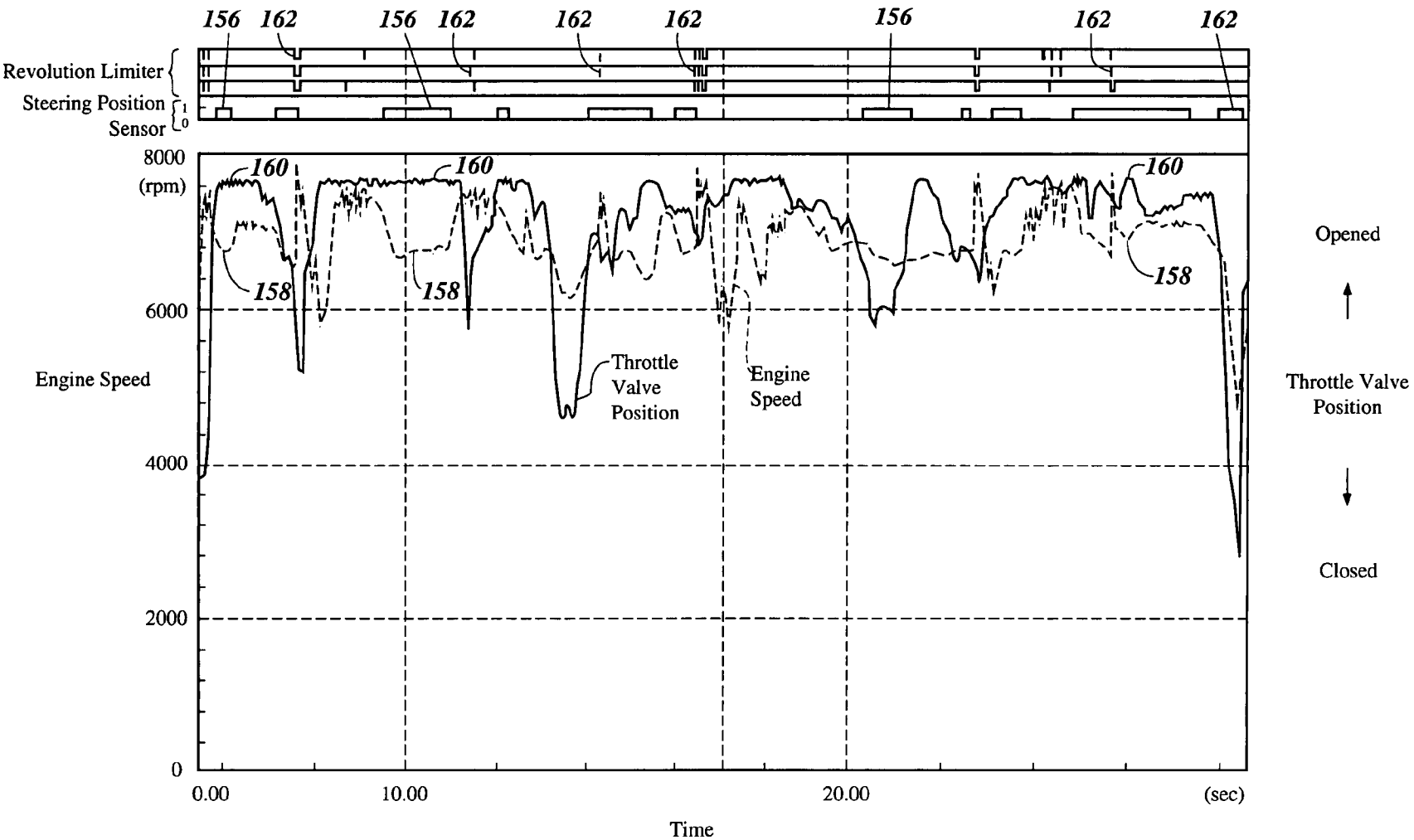
FIG. 9 illustrates graph showing an exemplary operation of the watercraft of FIG. 2 under the control of the engine control system of FIG. 7 using the control program of FIG. 8, wherein lower and upper graphs are included. The lower graph shows engine speed and throttle valve opening degree versus time, and the upper graph shows operations of a revolution limiter and the steering position sensor versus the time.

FIG. 9 illustrates an exemplary operation of the watercraft 30 realized by the engine control system 34 using the control program 126. Generally, the engine speed varies along with changes of the throttle valve position unless the steering position is greater than the preset position (i.e., unless the steering position sensor 134 outputs the signal "1," which as indicated by the reference numeral 156). However, the engine speed rapidly falls (this state is indicated by the reference numeral 158) when the steering position becomes greater than the preset position (i.e., when the steering position sensor outputs the signal "1") even though the throttle valves are fully opened (this state is indicated by the reference numeral 160), because the control system 34 inhibits the engine speed from rising toward the over-revolution state under this condition. Thus, the revolution limiter works less frequently than in the operation shown in FIG. 1. Operations of the revolution limiter are indicated by the reference numeral 162 in FIG. 9. The control system configured in accordance with the present invention thus is quite effective to inhibit the engine from over-revving.

In one variation, the ECU does not necessarily watch the time elapse. Instead, the ECU can watch whether the engine speed falls to a desired normal engine speed and can stop the increment of the fuel injection amount when the engine speed reaches this normal engine speed for a given operating condition (e.g., turn angle).

The engine control system can have an air intake pressure sensor downstream of the throttle valve(s) or an airflow amount sensor alternatively or in addition to the throttle valve position sensor. In one central program, the ECU can determine whether an air intake pressure and/or airflow amount sensed by those sensors is equal to or greater than a preset magnitude instead determining the throttle valve position because the air intake pressure and the airflow amount vary generally in accordance with the throttle valve position.

Also, the ECU can decrease the fuel injection amount at Step S5 instead of increasing the fuel injection amount because the air/fuel ratio also will be incorrect if the fuel injection amount is lessened than the normal amount corresponding to the intake air amount.

Further, the ECU can use other ways to decrease the engine power. For example, the ECU can retard ignition timing for this purpose.

Figure 10:
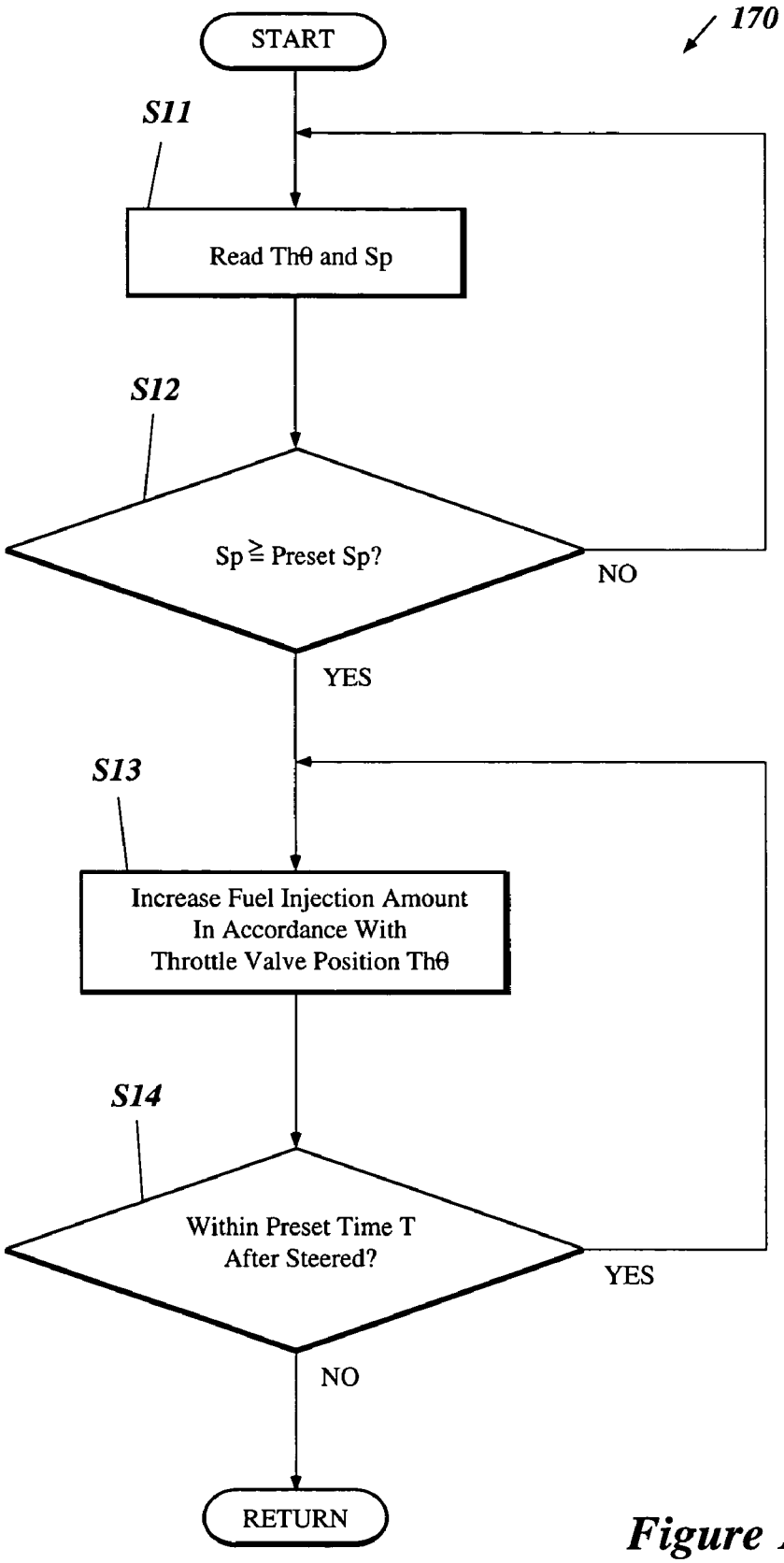
FIG. 10 illustrates a flow chart of a modified (second) embodiment of the control program that can be used with the engine control system of FIG. 7.
Figure 11:
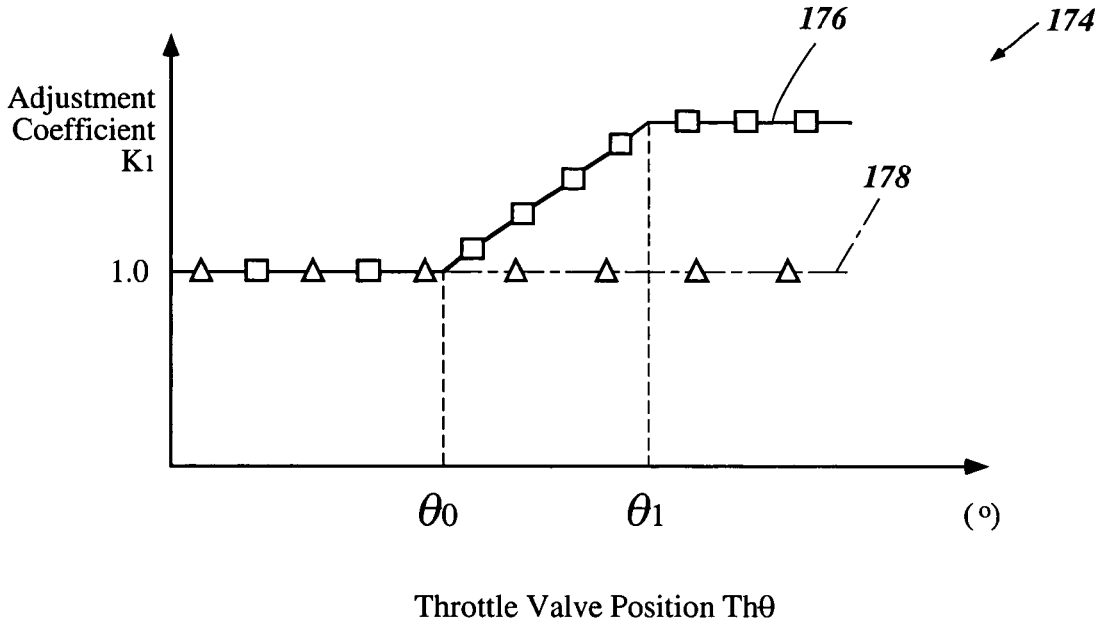
FIG. 11 illustrates a control map used in conducting the control program of FIG. 10, wherein the control map provides an adjustment coefficient $K_1$ versus a throttle valve position (opening degree) Thθ.

FIGS. 10 and 11 illustrate another control operation that the control system 34 can perform. In this control operation, the ECU 118 uses a modified control program 170, which is another preferred embodiment of the control program. The same devices, components, members, signals, and commands as those described above are assigned with the same reference numerals or symbols and are not repeatedly described unless specific descriptions of them are necessary. It should be noted that the other embodiments and variations that later follow are described in the same manner.

With reference to FIG. 10, the program 170 starts at Step S11. The ECU 118 reads a throttle valve position Thθ and a steering position Sp from the throttle valve position sensor 130 and the steering position sensor 134, respectively. The program 170 then goes to Step S12.

At Step S12, the ECU 118 determines whether the steering mast 44 is steered to or beyond a preset angular position using the steering position Sp. If the determination is negative, the ECU 118 recognizes that no particular control is necessary. The program 170 returns back to Step S11 to repeat Step S11. The ECU 118 controls the engine 32 with the basic control program under this condition. If the determination at Step S12 is positive, the program 170 goes to Step S13.

The ECU 118, at Step S13, controls the fuel injection amount by referring the control map 174 of FIG. 11. The control map 174 provides an adjustment coefficient $K_1$ versus a throttle valve position Thθ. Preferably, the adjustment coefficient $K_1$ is "1.0" when the throttle valve position Thθ is lower than $\theta_0$. Generally, the adjustment coefficient $K_1$ increases linearly (see, e.g., line 176) to a certain value of the adjustment coefficient $K_1$ that is greater than "1.0" when the throttle valve position Thθ lies between the throttle valve positions $\theta_0$ and a throttle valve position $\theta_1$. The adjustment coefficient $K_1$ stays at the same value as the value corresponding to the throttle valve position $\theta_1$ when the throttle valve position Thθ is greater than $\theta_1$. If the adjustment coefficient $K_1$ is "1.0," no adjustment is made to a normal fuel injection amount. Under the normal condition of the operation, the adjustment coefficient $K_1$ does not vary as indicated by the phantom line 178 of FIG. 11.

A fuel injection amount per one injection is calculated by multiplying the normal fuel injection amount by the adjustment coefficient $K_1$. That is, if the normal fuel injection amount is Q and an adjusted fuel injection amount is $Q_A$, the following equation can give the adjusted fuel injection amount $Q_A$:

$$Q_A = Q \times K_1$$

Because the fuel injection amount is increased in the throttle valve position range greater than the throttle valve position $\theta_0$, the air/fuel ratio becomes unbalanced (specifically rich) in this throttle valve position range. The engine speed Es thus decreases. The program 170 then proceeds to Step S14.

At Step S14, the ECU 118 determines whether a time that elapses after the steering mast 44 was steered is within a preset time T. The determination is positive at the first moment and the program 170 returns to Step S13 to repeat Steps S13 and S14.

The determination at Step S14 eventually will become negative during one of the loops. The program 170 then returns to Step S11 to repeat Step S11. With the execution of this control sub-routine, the engine speed Es slows down.

Figure 12:
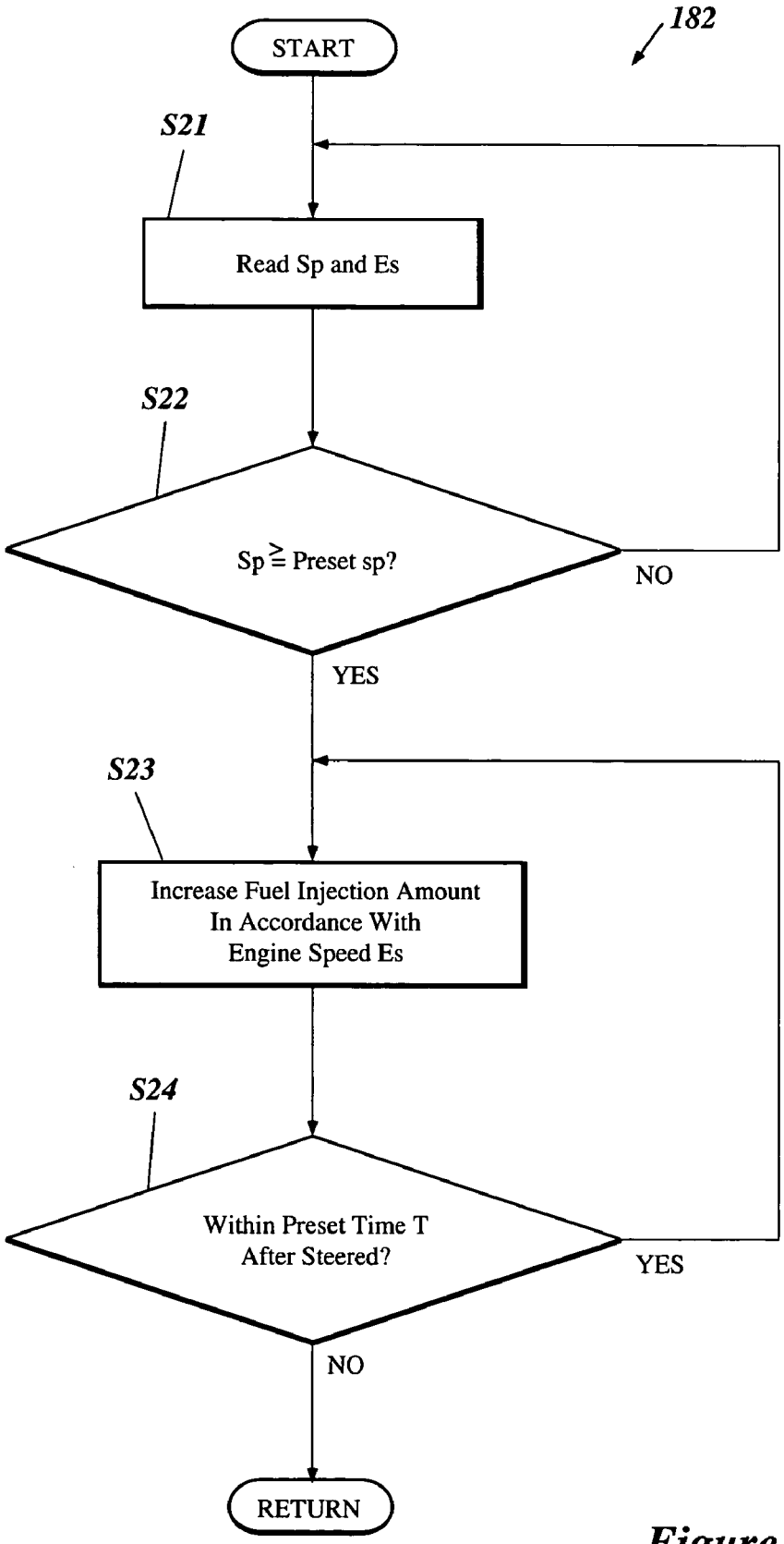
FIG. 12 illustrates a flow chart of another modified embodiment of the control program that can be used with the engine control system of FIG. 7.
Figure 13:
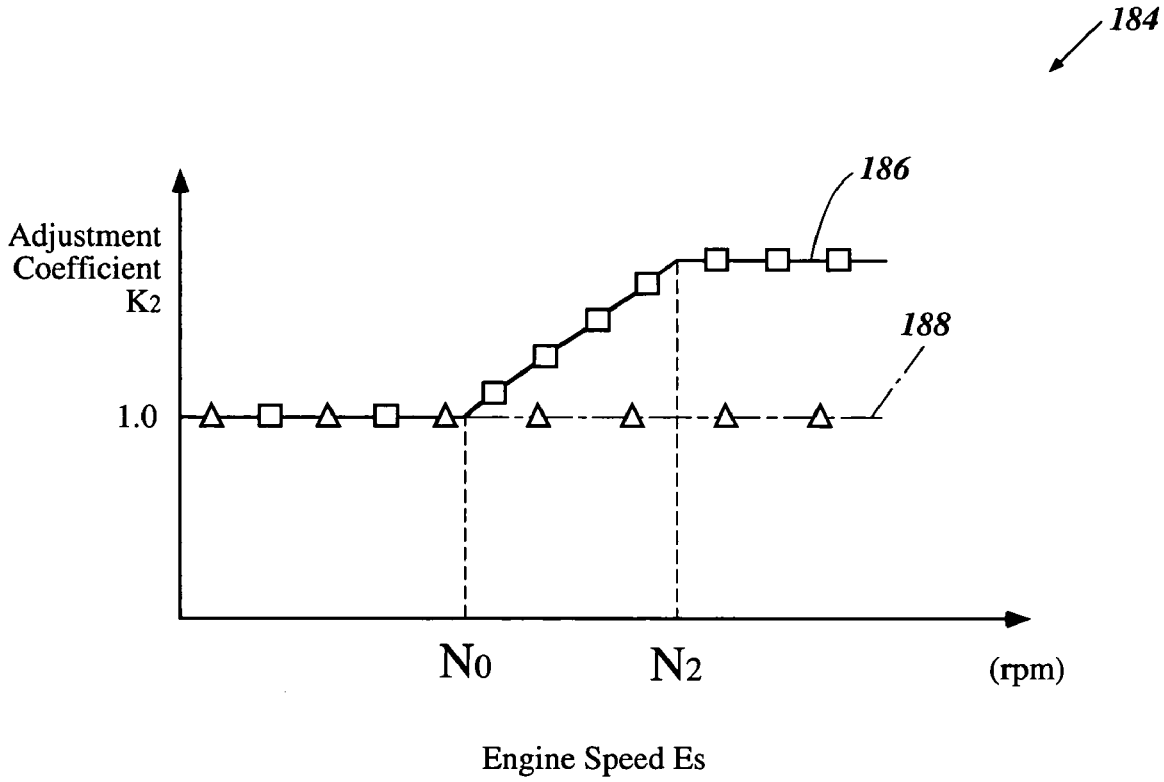
FIG. 13 illustrates another control map used in conducting the control program of FIG. 12, wherein the control map provides an adjustment coefficient $K_2$ versus an engine speed Es.

FIGS. 12 and 13 illustrate a further control operation that the control system 34 can perform. In this control operation, the ECU 118 uses another modified control program 182.

With reference to FIG. 12, the program 182 starts at Step S21. The ECU 118 reads a steering position Sp from the steering position sensor 134. The ECU 118 also reads the engine speed Es that the ECU 118 calculates based upon the signal from the crankshaft angle position sensor 140. The program 182 then goes to Step S22.

At Step S22, the ECU 118 determines whether the steering mast 44 is steered to or beyond a preset angular position using the steering position signal Sp. If the determination is negative, the ECU 118 recognizes that no particular control is necessary. The program 182 returns to Step S21 to repeat Step S21. The ECU 118 controls the engine 32 with the basic control program under this condition. If the determination at Step S22 is positive, the program 182 proceeds to Step S23.

The ECU 118, at Step S23, controls the fuel injection amount by referring the control map 184 of FIG. 13. The control map 184 provides an adjustment coefficient $K_2$ versus engine speed Es. Preferably, the adjustment coefficient $K_2$ is "1.0" when the engine speed Es is lower than $N_0$. Generally, the adjustment coefficient $K_2$ increases linearly (see, e.g., line 186) to a certain value of the adjustment coefficient $K_2$ that is greater than "1.0" when the engine speed Es is between the engine speed $N_0$ and an engine speed $N_1$. The adjustment coefficient $K_2$ stays at the same value as the value corresponding to the engine speed $N_1$ when the engine speed Es is greater than $N_1$. If the adjustment coefficient $K_2$ is "1.0," no adjustment is made to a normal fuel injection amount. Under the normal condition of the operation, the adjustment coefficient $K_2$ does not vary as indicated by the phantom line 188 of FIG. 13.

A fuel injection amount per one injection is calculated by multiplying the normal fuel injection amount by the adjustment coefficient $K_2$. That is, if the normal fuel injection amount is Q as noted above and an adjusted fuel injection amount is $Q_{A2}$, the following equation can give the adjusted fuel injection amount is $Q_{A2}$:

$$Q_{A2} = Q \times K_2$$

Because the fuel injection amount is increased in the engine speed range greater than the engine speed $N_0$, the air/fuel ratio becomes unbalanced (e.g., rich in the illustrated embodiment) in this engine speed range. The engine speed Es thus slows. The program 182 then goes to Step S24.

At Step S24, the ECU 118 determines whether a time that elapses after the steering mast 44 was steered beyond the predetermined angular position (e.g., 19°) is within a preset time T. The determination is positive at the first moment and the program 182 returns to Step S23 to repeat Steps S23 and S24.

The determination at Step S24 will eventually become negative during one of the loops between Steps S23 and S24. The program 182 then returns to Step S21 to repeat Step S21. The engine speed Es has slowed down. Preferably, the preset time T is selected to provide sufficient slowing of the engine to inhibit engine over-revving under a meaningful number of different operating conditions.

Figure 14:
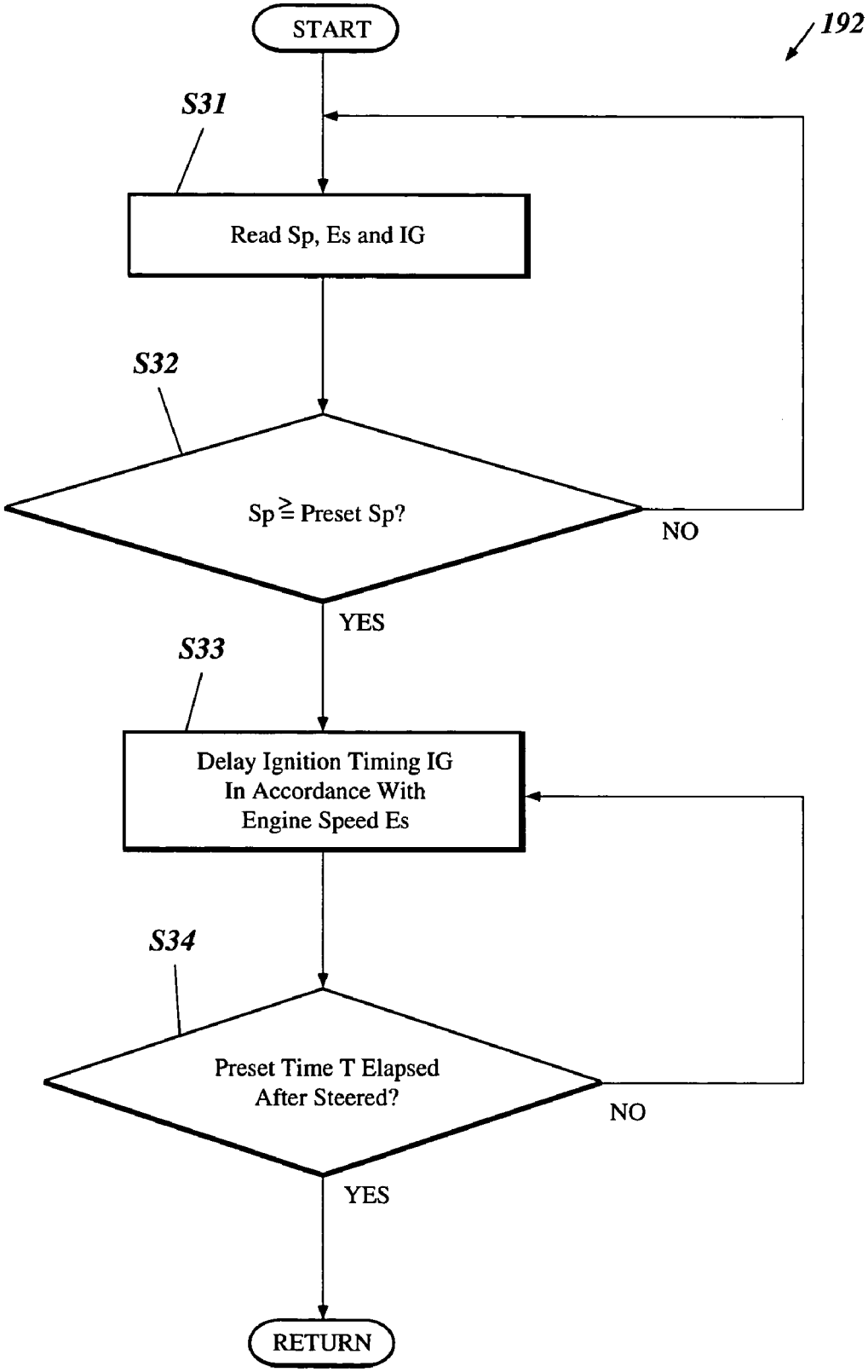
FIG. 14 illustrates a flow chart of a further modified embodiment of the control program that can be used with the engine control system of FIG. 7.
Figure 15:
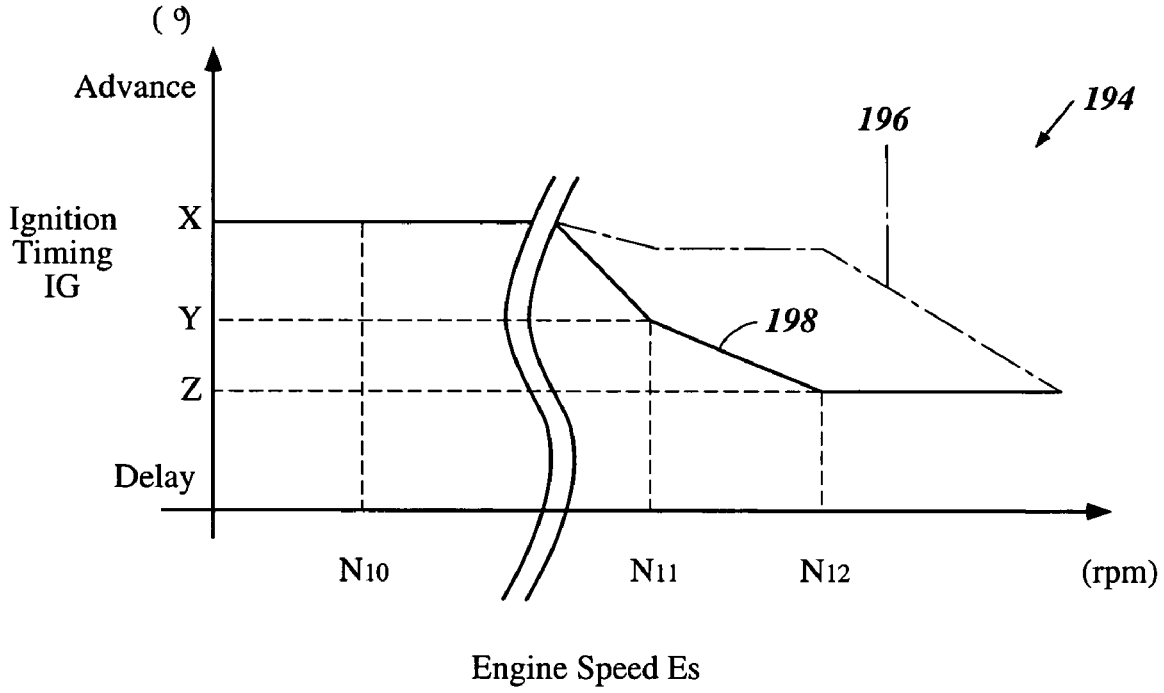
FIG. 15 illustrates another control map used in conducting the control program of FIG. 14, wherein the control map provides an adjusted ignition timing IG versus an engine speed Es.

FIGS. 14 and 15 illustrate a further control operation that can be performed by the control system 34. In this control operation, the ECU 118 uses a further modified control program 192.

With reference to FIG. 14, the program 192 starts at Step S31. The ECU 118 reads a steering position Sp from the steering position sensor 134. The ECU 118 also reads (1) the engine speed Es that the ECU 118 has calculated based upon the signal from the crankshaft angle position sensor 140 and (2) an ignition timing IG. The program 192 then proceeds to Step S32.

At Step S32, the ECU 118 determines whether the steering mast 44 is steered to or beyond a preset angular position using the steering position signal Sp. If the determination is negative, the ECU 118 recognizes that no particular control is necessary. The program 192 returns to Step S31 to repeat Step S31. The ECU 118 controls the engine 32 with the basic control program under this condition. If the determination at Step S32 is positive, the program 192 goes to Step S33.

The ECU 118, at Step S33, controls the ignition timing by referring to a control map 194 of FIG. 15. The control map 194 provides ignition timing IG versus engine speed Es. In general, the ignition timing is normally delayed (retarded) when the engine operates in a relatively high engine speed range, as illustrated by the phantom line 196 of FIG. 15. As seen in this figure, the ECU normally retards ignition timing at higher engine speeds relative to the ignition timing used at slower speeds (for example, that shown of the left side of the graph). The adjusted ignition timing is even more delayed than the normal ignition timing, as illustrated by line 198 of FIG. 15. For example, the adjusted ignition timing is X at the engine speed $N_{10}$ and the timing X is the same as the timing of the normal ignition timing at this engine speed $N_{10}$. However, the adjusted ignition timing Y at the engine speed $N_{11}$ (where $N_{10}<N_{11}$) is delayed more than the timing of the normal ignition timing at the same engine speed $N_{11}$. Further, the adjusted ignition timing Z at the engine speed $N_{12}$ (where $N_{11}<N_{12}$) is delayed more than the timing of the normal ignition timing at the same engine speed $N_{12}$. The adjusted ignition timings X, Y, Z. for example, are target ignition timings in this control strategy.

The ECU 118 calculates a difference between a current ignition timing and each target ignition timing and adjusts the ignition timing in response to the difference. Accordingly, each spark plug is ignited at the adjusted ignition timing (i.e., the target ignition timing) by the ignition circuit in accordance with the determined engine speed Es. Because the ignition timing is delayed in the relatively high engine speed range, engine speed decreases toward a proper range. The program 192 then proceeds to Step S34.

At Step S34, the ECU 118 determines whether a preset time T has elapsed since the steering mast 44 was turned to or beyond a preset limit (e.g., 19°). The determination is negative at the first moment and the program 192 returns to Step S33 to repeat Steps S33 and S34.

The determination at Step S34 will eventually become positive during one of the loops between Steps S33 and S34. The program 192 then returns to Step S31 to repeat the step. The engine speed Es preferably has slowed to a proper range (e.g., below an over-revving state).

Figure 16:
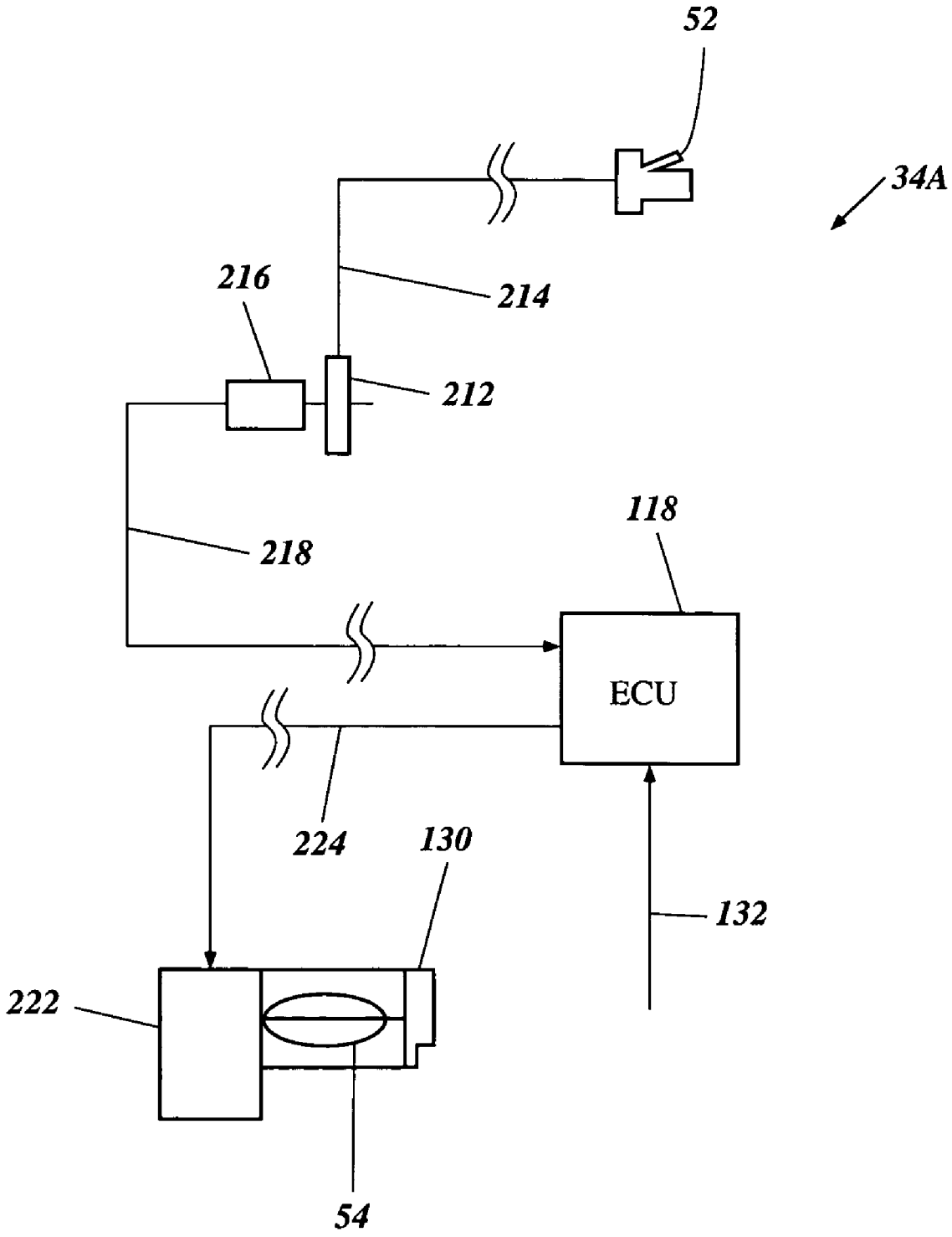
FIG. 16 is a diagram of an engine control system in accordance with another preferred embodiment of the present invention.
Figure 17:
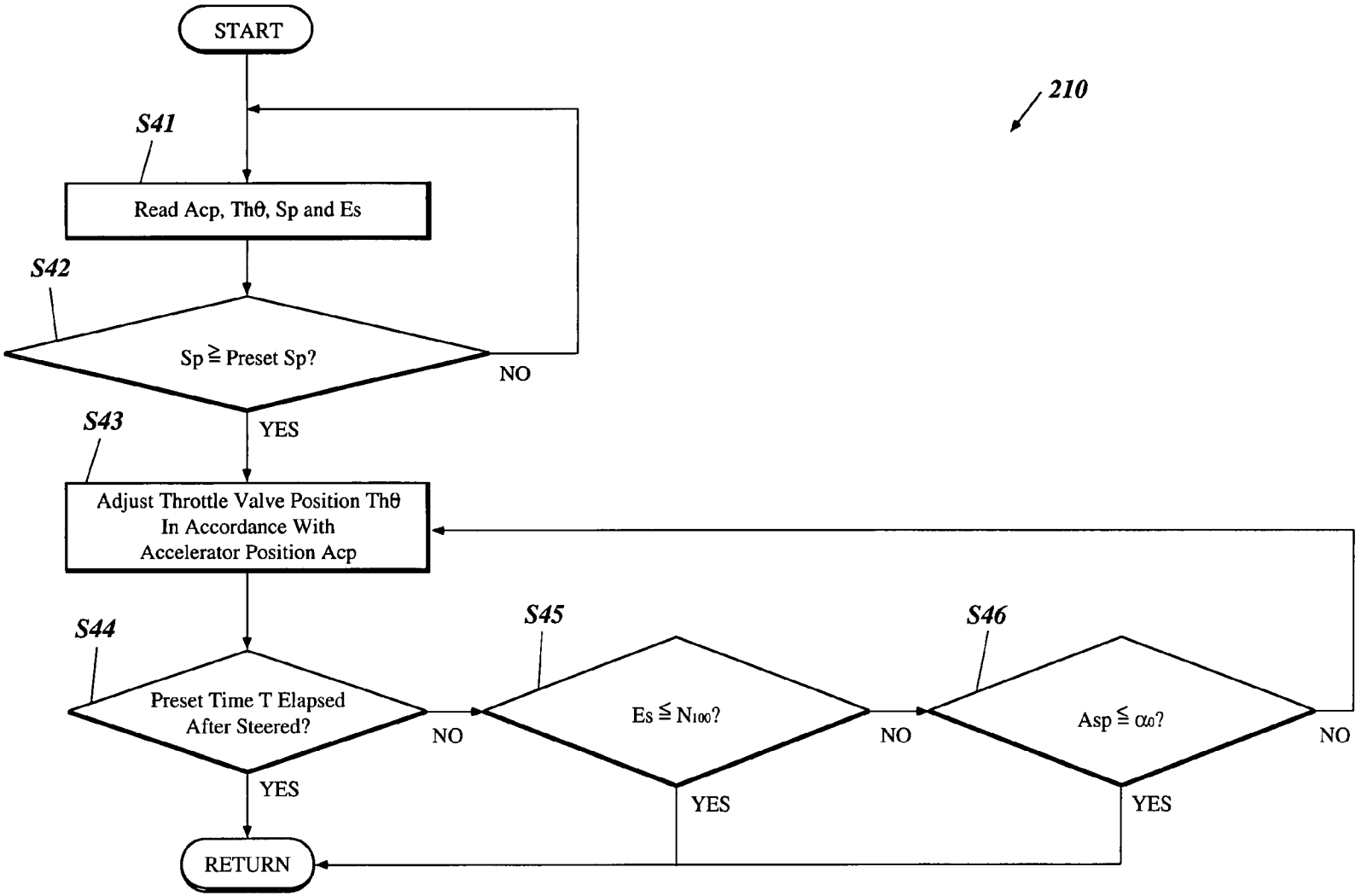
FIG. 17 illustrates a flow chart of a further modified embodiment of the control program that is applied to the modified engine control system of FIG. 16.
Figure 18:
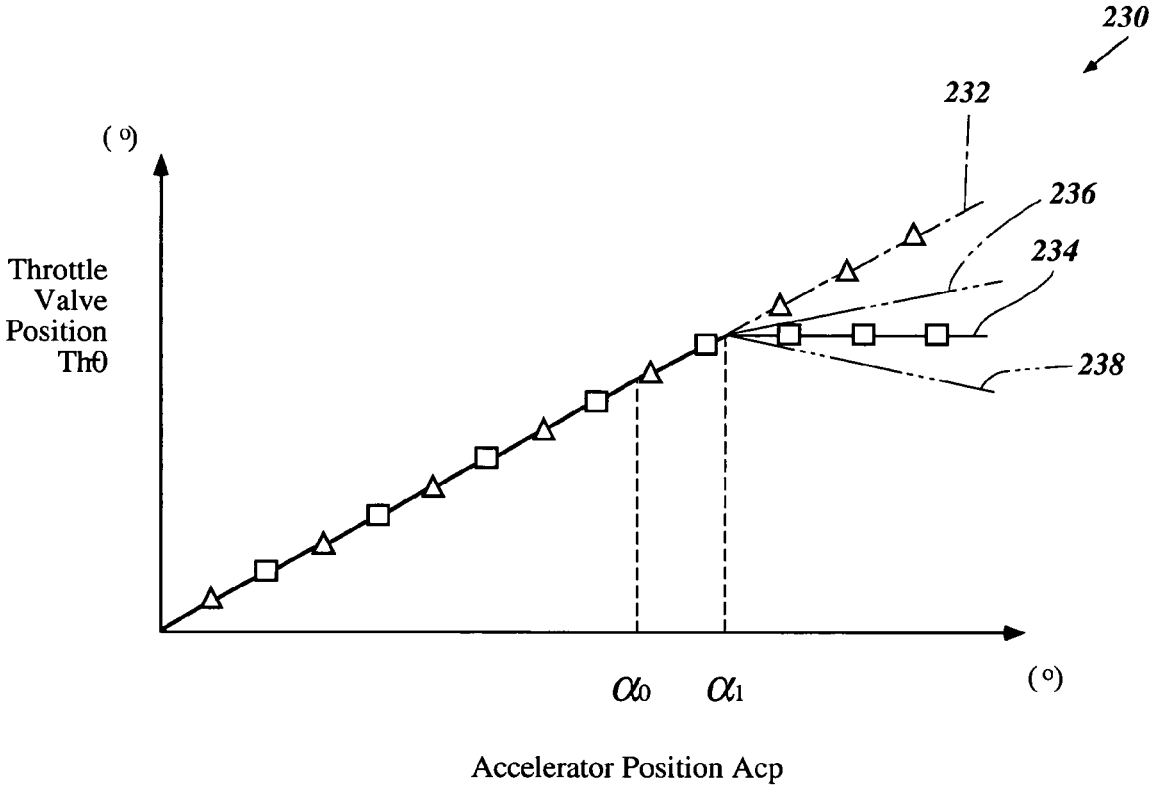
FIG. 18 illustrates a control map used in conducting the control program of FIG. 17, wherein the control map provides a throttle valve position (opening degree) Thθ versus a position Acp of an intermediate operating device (an accelerator position).

With reference to FIGS. 16–18, a control operation, which is executed by another control system 34A, can be used with the watercraft 30. The control system 34A in this embodiment is slightly changed from the control system 34 described above. In this control operation, the ECU 118 uses a further modified control program 210.

With reference to FIG. 16, the control system 34A electrically controls the throttle valve position Thθ by the ECU 118 rather than mechanically controlling the throttle valve position Thθ. An intermediate operating device 212 preferably is connected to the throttle lever 52 through a mechanical cable 214. The intermediate operating device 212 varies between a "lower" position and a "higher" position in accordance with the movement of the throttle lever 52. An operating device position sensor 216 is coupled with the intermediate operating device 212 to sense the position of the intermediate operating device 212 within a range established by and between the lower and higher positions. The sensed position of the intermediate operating device 212 is transferred to the ECU 118 through a signal line 218. In this arrangement, either the throttle lever 52 or the intermediate operating device 212 is considered to be a throttle valve operating device.

In one variation, the intermediate operating device 212 and the mechanical cable 24 can be omitted. The operating device position sensor 216 in this variation can be directly coupled with the throttle lever 52 and senses a position of the throttle lever 52. The throttle lever 52 is considered to be a throttle valve operating device in this arrangement.

Because the throttle lever 52 or the intermediate operating device 212 is an accelerator, the position of the intermediate operating device 212 or the throttle lever 52 is called as an accelerator position Acp in this description.

An actuator 222 is coupled with the valve shaft of the throttle valves 54 to move the throttle valves 54. The actuator 222 can include a servo-motor, for example. The ECU 118 controls the actuator 222 through a control line 224 using at least the control program 210.

With reference to FIG. 17, the program 210 starts at Step S41. The ECU 118 reads an accelerator position Acp, a throttle valve position Thθ and a steering position Sp from the operating device position sensor 216 and the steering position sensor 134, respectively. The ECU 118 also reads the engine speed Es that it calculated based upon the signal from the crankshaft angle position sensor 140. The program 210 then goes to Step S42.

At Step S42, the ECU 118 determines whether the steering mast 44 is steered to or beyond a preset angular position using the steering position signal Sp. If the determination is negative, the ECU 118 recognizes that no particular control is necessary. The program 210 returns to Step S41 to repeat the step. The ECU 118 controls the engine 32 with a basic control program under the condition. If the determination at Step S42 is positive, the program 210 proceeds to Step S43.

The ECU 118, at Step S43, controls the throttle valve position Thθ by referring to a control map 230, which is shown in FIG. 18. The control map 230 provides adjusted throttle valve position versus accelerator position Acp. In general, the normal throttle valve position can vary in proportion to the accelerator position Acp, as illustrated by the phantom line 232 of FIG. 18 when controlled in accordance with program 210. An adjusted throttle valve position does not vary when the accelerator position Acp is greater than $\alpha_1$ and stays at the throttle valve position of the accelerator position $\alpha_1$, as illustrated by line 234 of FIG. 18.

In a variation of this control strategy, the adjusted throttle valve position can vary within this particular range (i.e., with the accelerator position of $\alpha_1$ or above in the illustrated embodiment), but at a smaller change rate than that of the normal throttle valve position. That is, as illustrated by line 232 in FIG. 18, the throttle valve position normally has a generally linear relationship to the accelerator position Acp. However, when the rider attempts to turn by more than a preset degree while the accelerator position Acp is at least equal to $\alpha_1$, the controller ceases the linear correspondence between the accelerator position Acp and the throttle valve position Thθ. For example, phantom lines 236, 238 of FIG. 18 indicate other possible relationships between the adjusted throttle valve position and the accelerator position Acp within this range of accelerator positions. However, regardless of which map is used (lines 234, 236, 238), the adjusted throttle mapped valve positions are target throttle valve positions in this control towards which the actuator 222 moves throttle valve 54.

The ECU 118 calculates a difference between a current throttle valve position sensed by the throttle valve position sensor 130 and the target throttle valve position. The ECU 118 then adjusts the throttle valve position in response to the difference. That is, the ECU 118 activates the actuator 222 to move to cancel the difference. The throttle valve position thus is set at the adjusted throttle valve position (i.e., the target throttle valve position). Accordingly, the air amount is regulated by the adjusted throttle valve. Because the throttle valve opening degree is smaller than that of the normal condition in the range that the accelerator position Acp is greater than $\alpha_1$, the engine speed Es slows toward a proper range. The program 210 then proceeds to Step S44.

At Step S44, the ECU 118 determines whether a preset time T has elapsed since the steering mast 44 was turned to or beyond the preset degree (e.g., 19°). The determination is negative at the first moment and the program 210 goes to Step S45.

The ECU 118, at Step S45, determines whether the engine speed Es is lower than a preset engine speed $N_{100}$, which is a sufficiently low engine speed that does not cause the over-revving. If the determination is positive, the ECU 118 recognizes that the particular control is no longer necessary and the program 210 returns to Step S41 to repeat Step S41. If the determination at Step S45 is negative, the program 210 goes to Step S46.

At Step S46, the ECU 118 determines whether the accelerator position Acp is less than a threshold accelerator position $\alpha_0$ ($\alpha_0<\alpha_1$). If the determination is positive, the ECU 118 recognizes that the rider has released the throttle lever 52 or at least has an intention to slow down the engine speed Es, and the program 210 returns to Step S41 and repeats Step S41. If the determination at Step S46 is negative, the program 210 returns to Step S43 and repeats Step S43.

In one variation, the threshold accelerator position $\alpha_0$ can be the same as the accelerator position $\alpha_1$.

In repeating Steps S43, S44, S45 and S46, at least one of the determinations at Steps S43, S44, S45 and S46 will eventually become positive during this loop. The program 210 then returns to Step S41 to repeat Step S41. The engine speed Es has slowed preferably to a desired range.

The control programs 126, 170, 182, 192 and 210 can have a further step to determine whether one or more (e.g., all) of the sensors are functioning properly prior to make the determinations described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the control system and its operation have been shown and described in detail, other modifications, which are within the scope of this invention, will be readily apparent to those of skill in the art based upon this disclosure. For example, while the ECU has been described as being directly wired to each sensor and actuator (e.g., to the actuators for throttle movement, ignition, and fuel injection), the communication between the ECU and such components of the control system (as well as among themselves) can be accomplished via a local area network and/or via radio-frequency transmission/reception or the like. It is also contemplated that various combination or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A watercraft comprising a propulsion device, an internal combustion engine powering the propulsion device, a control device configured to control a magnitude of engine power produced by the engine, a steering mechanism arranged to steer a thrust direction of the propulsion device, first sensing means for sensing the magnitude of engine power or a magnitude of engine load, and second sensing means for sensing an angular position of the steering mechanism, the control device decreasing the magnitude of engine power when the control device determines that the magnitude of engine power is greater than a preset magnitude of engine power or the magnitude of engine load is greater than a preset magnitude of engine load based upon an output from the first sensing means and that the angular position of the steering mechanism is greater than a preset angular position based upon an output from the second sensing means, without regard to a rate of change of engine power or engine load.

2. The watercraft as set forth in claim 1, wherein the control device decreases the magnitude of engine power for a preset period of time.

3. The watercraft as set forth in claim 2, wherein the preset period of time starts after the control device determines that the angular position of the steering mechanism is greater than the preset angular position.

4. The watercraft as set forth in claim 1, wherein the first sensing means is an engine load sensing device.

5. The watercraft as set forth in claim 4 additionally comprising an air intake system arranged to introduce air into a combustion chamber of the engine, the air intake system including a throttle valve that regulates an amount of the air, the engine load sensing device being a throttle valve opening degree sensor that senses an opening degree of the throttle valve.

6. The watercraft as set forth in claim 5, wherein the control device determines that the magnitude of engine load is greater than the preset magnitude of engine load when the throttle valve opening degree sensor senses that the throttle valve opens more than a preset opening degree.

7. The watercraft as set forth in claim 1, wherein the first sensing means is an engine speed sensing device.

8. The watercraft as set forth in claim 7, wherein the control device determines that the magnitude of engine power is greater than the preset magnitude of engine power when the engine speed sensor senses that the engine speed is greater than a preset engine speed.

9. The watercraft as set forth in claim 1 additionally comprising a fuel supply system arranged to supply fuel to a combustion chamber of the engine, the control device increasing an amount of the fuel to decrease the magnitude of engine power.

10. The watercraft as set forth in claim 1 additionally comprising an air intake system arranged to introduce air into a combustion chamber of the engine, and a fuel supply system arranged to supply fuel to the combustion chamber, the control device controlling an amount of the fuel in accordance with an amount of the air, the control device changing the amount of the fuel not to accord with the amount of the air to decrease the magnitude of engine power.

11. The watercraft as set forth in claim 1 additionally comprising an air intake system arranged to introduce air into a combustion chamber of the engine, a fuel supply system arranged to supply fuel to the combustion chamber, and an ignition system that ignite an air/fuel charge in the combustion chamber, the control device delaying a timing of the ignition to decrease the magnitude of engine power.

12. The watercraft as set forth in claim 1 additionally comprising an air intake system arranged to introduce air into a combustion chamber of the engine, the air intake system including a throttle valve that regulate an amount of the air, the control device adjusting an opening degree of the throttle valve to decrease the magnitude of engine power.

13. The watercraft as set forth in claim 12, wherein the control device inhibits the throttle valve from opening to adjust the opening degree.

14. The watercraft as set forth in claim 1, wherein the watercraft has a water tunnel, the propulsion device comprises a jet pump unit incorporating an impeller and communicating with the water tunnel.

15. A watercraft comprising a propulsion device, an internal combustion engine powering the propulsion device, a control device configured to control a magnitude of engine power produced by the engine, a steering mechanism arranged to steer a thrust direction of the propulsion device, first sensing means for sensing the magnitude of engine power or a magnitude of engine load, and second sensing means for sensing an angular position of the steering mechanism, the control device decreasing the magnitude of engine power when the control device determines that the magnitude of engine power is greater than a preset magnitude of engine power or the magnitude of engine load is greater than a preset magnitude of engine load based upon an output from the first sensing means and that the angular position of the steering mechanism is greater than a preset angular position based upon an output from the second sensing means, wherein the first sensing means is an engine load sensing device, additionally comprising an air intake system arranged to introduce air into a combustion chamber of the engine, the air intake system including a throttle valve that regulates an amount of the air, the engine load sensing device being a throttle valve opening degree sensor that senses an opening degree of the throttle valve, and wherein the control device determines that the magnitude of engine load is greater than the preset magnitude of engine load when the throttle valve opening degree sensor senses that the throttle valve is at least about fully opened.

16. A watercraft comprising a propulsion device, an internal combustion engine powering the propulsion device, a control device configured to control a magnitude of engine power produced by the engine, a steering mechanism arranged to steer a thrust direction of the propulsion device, first sensing means for sensing the magnitude of engine power or a magnitude of engine load, and second sensing means for sensing an angular position of the steering mechanism, the control device decreasing the magnitude of engine power when the control device determines that the magnitude of engine power is greater than a preset magnitude of engine power or the magnitude of engine load is greater than a preset magnitude of engine load based upon an output from the first sensing means and that the angular position of the steering mechanism is greater than a preset angular position based upon an output from the second sensing means, wherein the first sensing means is an engine load sensing device, additionally comprising an air intake system arranged to introduce air into a combustion chamber of the engine, the air intake system including a throttle valve that regulate an amount of the air, and a throttle valve operating device remotely disposed relative to the throttle valve, a position of the throttle valve operating device varying between a lower position and a higher position, an opening degree of the throttle valve varying in accordance with the position of the throttle valve operating device, and the engine load sensing device being a throttle valve operating device position sensor that senses the position of the throttle valve operating device.

17. The watercraft as set forth in claim 16, wherein the control device determines that the magnitude of engine load is greater than the preset magnitude of engine load when the throttle valve operating device position sensor senses that the throttle valve operating device is placed at a position higher than a preset position.

18. The watercraft as set forth in claim 17, wherein the control device decreases the magnitude of engine power until a preset period of time elapses or until the throttle valve operating device position sensor senses that the throttle valve operating device is placed at a position lower than a second preset position.

19. The watercraft as set forth in claim 18, wherein the second preset position is set at a position lower than the first preset position.

20. The watercraft as set forth in claim 16, wherein the control device decreases the magnitude of engine power until a preset period of time elapses or until the throttle valve operating device position sensor senses that the throttle valve operating device is placed at a position lower than a preset position.

21. A watercraft comprising a propulsion device, an internal combustion engine powering the propulsion device, a control device configured to control an engine speed of the engine, a steering mechanism arranged to steer a thrust direction of the propulsion device, an engine load sensing device configured to sense an engine load of the engine, and a steering position sensing device configured to sense an angular position of the steering mechanism, the control device decreasing the engine speed when the control device determines that the engine load is greater than a preset engine load based upon an output from the engine load sensing device and that the angular position of the steering mechanism is greater than a preset angular position based upon an output from the steering position sensing device, without regard to a rate of change of the engine load.

22. The watercraft as set forth in claim 21, wherein the control device decreases the engine speed for a preset period of time.

23. The watercraft as set forth in claim 21 additionally comprising an air intake system arranged to introduce air into a combustion chamber of the engine, the air intake system including a throttle valve that regulates an amount of the air, the engine load sensing device being a throttle valve opening degree sensor that senses an opening degree of the throttle valve.

24. The watercraft as set forth in claim 23, wherein the control device determines that the engine load is greater than the preset engine load when the throttle valve opening degree sensor senses that the throttle valve opens more than a preset opening degree.

25. The watercraft as set forth in claim 21 additionally comprising a fuel supply system arranged to supply fuel to a combustion chamber of the engine, the control device increasing an amount of the fuel to decrease the engine speed.

26. The watercraft as set forth in claim 21 additionally comprising an air intake system arranged to introduce air into a combustion chamber of the engine, the air intake system including a throttle valve that regulate an amount of the air, the control device adjusting an opening degree to decrease the engine load.

27. A watercraft comprising a propulsion device, an internal combustion engine powering the propulsion device, a control device configured to control an engine speed of the engine, a steering mechanism arranged to steer a thrust direction of the propulsion device, an engine load sensing device configured to sense an engine load of the engine, and a steering position sensing device configured to sense an angular position of the steering mechanism, the control device decreasing the engine speed when the control device determines that the engine load is greater than a preset engine load based upon an output from the engine load sensing device and that the angular position of the steering mechanism is greater than a preset angular position based upon an output from the steering position sensing device, additionally comprising an air intake system arranged to introduce air into a combustion chamber of the engine, the air intake system including a throttle valve that regulates an amount of the air, the engine load sensing device being a throttle valve opening degree sensor that senses an opening degree of the throttle valve, wherein the control device determines that the engine load is greater than the preset engine load when the throttle valve position sensor senses that the throttle valve is at least about fully opened.

28. A watercraft comprising a propulsion device, an internal combustion engine powering the propulsion device, a control device configured to control an engine speed of the engine, a steering mechanism arranged to steer a thrust direction of the propulsion device, an engine load sensing device configured to sense an engine load of the engine, and a steering position sensing device configured to sense an angular position of the steering mechanism, the control device decreasing the engine speed when the control device determines that the engine load is greater than a preset engine load based upon an output from the engine load sensing device and that the angular position of the steering mechanism is greater than a preset angular position based upon an output from the steering position sensing device, additionally comprising an air intake system arranged to introduce air into a combustion chamber of the engine, the air intake system including a throttle valve that regulate an amount of the air, a throttle valve operating device remotely disposed relative to the throttle valve, and a position of the throttle valve operating device varying between a lower position and a higher position, an opening degree of the throttle valve varying in accordance with the position of the throttle valve operating device, and the engine load sensing device being a throttle valve operating device position sensor that senses the position of the throttle valve operating device.

29. The watercraft as set forth in claim 28, wherein the control device determines that the engine load is greater than the preset engine load when the throttle valve operating device position sensor senses that the throttle valve operating device is placed at a position higher than a preset position.

30. The watercraft as set forth in claim 29, wherein the control device decreases the engine speed until a preset period of time elapses, until the engine speed decreases lower than a preset engine speed, or until the throttle valve operating device position sensor senses that the throttle valve operating device is placed at a position lower than a second preset position.

31. The watercraft as set forth in claim 30, wherein the second preset position is set at a position lower than the first preset position.

32. The watercraft as set forth in claim 28, wherein the control device decreases the engine speed until a preset period of time elapses, until the engine speed decreases lower than a preset engine speed, or until the throttle valve operating device position sensor senses that the throttle valve operating device is placed at a position lower than a preset position.

33. A watercraft comprising a propulsion device, an internal combustion engine powering the propulsion device, a control device configured to control an engine speed of the engine, a steering mechanism arranged to steer a thrust direction of the propulsion device, an engine speed sensing device configured to sense an engine speed of the engine, and a steering position sensing device configured to sense an angular position of the steering mechanism, the control device decreasing the engine speed when the control device determines that the engine speed is greater than a preset engine speed based upon an output from the engine speed sensing device and that the angular position of the steering mechanism is greater than a preset angular position based upon an output from the steering position sensing device, without regard to a rate of change of engine speed.

34. The watercraft as set forth in claim 33, wherein the control device decreases the engine speed for a preset period of time.

35. The watercraft as set forth in claim 33 additionally comprising a fuel supply system arranged to supply fuel to a combustion chamber of the engine, the control device increasing an amount of the fuel to decrease the engine speed.

36. The watercraft as set forth in claim 33 additionally comprising an air intake system arranged to introduce air into a combustion chamber of the engine, a fuel supply system arranged to supply fuel to the combustion chamber, and an ignition system that ignite an air/fuel charge in the combustion chamber, the control device delaying a timing of the ignition to decrease the engine speed.

37. A control method of an engine for a watercraft having a steering mechanism arranged to steer a direction of the watercraft, the control method comprising sensing a magnitude of engine power of the engine or a magnitude of engine load, sensing an angular position of the steering mechanism, determining whether the magnitude of engine power is greater than a preset magnitude of engine power or the magnitude of engine load is greater than a preset magnitude of engine load, determining whether the angular position of the steering mechanism is greater than a preset angular position, and decreasing the magnitude of engine power when the magnitude of engine power is greater than the preset magnitude of engine power or the magnitude of engine load is greater than the preset magnitude of engine load regardless of a rate of change of the engine power or engine load and the angular position of the steering mechanism is greater than the preset angular position.

38. The control method as set forth in claim 37 additionally comprising determining whether a preset time elapses after determining that the angular position of the steering mechanism is greater than the preset angular position, and discontinuing the decrease of the magnitude of engine power when the preset time elapses.

39. The control method as set forth in claim 37 additionally comprising sensing an engine load to determine whether the magnitude of engine load is greater than the preset magnitude of engine load.

40. The control method as set forth in claim 37 additionally comprising sensing an engine speed to determine whether the magnitude of engine power is greater than the preset magnitude of engine power.

41. The control method as set forth in claim 37 additionally comprising supplying fuel to the engine and increasing an amount of the fuel to decrease the magnitude of engine power.

42. The control method as set forth in claim 37 additionally comprising igniting an air/fuel charge in the engine and delaying a timing of the ignition to decrease the magnitude of engine power.

43. The control method as set forth in claim 37 additionally comprising regulating an amount of air to the engine and adjusting a change rate of the regulation to decrease the magnitude of engine power.

44. A control method of an engine for a watercraft having a steering mechanism arranged to steer a direction of the watercraft, the control method comprising sensing an engine load of the engine, sensing an angular position of the steering mechanism, determining whether the engine load is greater than a preset engine load, determining whether the angular position of the steering mechanism is greater than a preset angular position, and decreasing an engine speed of the engine when the engine load is greater than the preset engine load and the angular position of the steering mechanism is greater than the preset angular position at all rates of change of engine load.

45. The control method as set forth in claim 44 additionally comprising determining whether a preset time elapses after determining that the angular position of the steering mechanism is greater than the preset angular position and discontinuing the decrease of the engine speed when the preset time elapses.

46. A control method of an engine for a watercraft having a steering mechanism arranged to steer a direction of the watercraft, the control method comprising sensing an engine speed of the engine, sensing an angular position of the steering mechanism, determining whether the engine speed is greater than a preset engine speed, determining whether the angular position of the steering mechanism is greater than a preset angular position, and decreasing an engine speed when the engine speed is greater than the preset engine speed and the angular position of the steering mechanism is greater than the preset angular position under all rates of change of engine speed.

47. The control method as set forth in claim 46 additionally comprising determining whether a preset time elapses after determining that the angular position of the steering mechanism is greater than the preset angular position and discontinuing the decrease of the engine speed when the preset time elapses.

* * * * *